US007654472B2

(12) United States Patent
Nolte et al.

(10) Patent No.: US 7,654,472 B2
(45) Date of Patent: Feb. 2, 2010

(54) ROTARY ATOMIZER WITH A SPRAYING BODY

(75) Inventors: Hans-Jürgen Nolte, Besigheim (DE); Harry Krumma, Bönnigheim (DE); Frank Herre, Oberriexingen (DE); Michael Baumann, Flein (DE); Marcus Frey, Weil der Stadt (DE); Rainer Melcher, Oberstenfeld (DE); Eberhardt Streisel, Vahingen-Enz (DE); Bernhard Seiz, Lauffen (DE); Peter Marquardt, Steinhelm (DE)

(73) Assignee: Durr Systems, Inc., Auburn Hills, MI (US)

( * ) Notice: Subject to any disclaimer, the term of this patent is extended or adjusted under 35 U.S.C. 154(b) by 135 days.

(21) Appl. No.: 11/551,699

(22) Filed: Oct. 20, 2006

(65) Prior Publication Data

US 2007/0090204 A1 Apr. 26, 2007

Related U.S. Application Data

(60) Provisional application No. 60/729,444, filed on Oct. 21, 2005.

(51) Int. Cl.
*B05B 3/10* (2006.01)

(52) U.S. Cl. ..... 239/223; 239/225.1

(58) Field of Classification Search ..... 239/223, 239/225.1, 240, 263, 600, 242, 700
See application file for complete search history.

(56) References Cited

U.S. PATENT DOCUMENTS

| | | | | |
|---|---|---|---|---|
| 5,078,321 | A * | 1/1992 | Davis et al. | 239/224 |
| 6,514,003 | B2 * | 2/2003 | Horikawa | 403/359.2 |
| 7,452,421 | B2 * | 11/2008 | Thome et al. | 118/323 |

FOREIGN PATENT DOCUMENTS

| | | |
|---|---|---|
| EP | 1266695 | 12/2002 |
| JP | 11028391 | 2/1999 |
| WO | WO-2005110617 | 11/2005 |

OTHER PUBLICATIONS

European Patent Office Search Report dated Apr. 21, 2009, EP 05 11 2394.

* cited by examiner

*Primary Examiner*—Davis Hwu
(74) *Attorney, Agent, or Firm*—Rader Fishman & Grauer

(57) ABSTRACT

The bell shaped plate of a rotary sprayer is attached to its drive shaft by means of a detachable device. An accidental self-release of the mounting device that would cause the rotating bell shaped plate to be flung off is avoided by measures that prevent at least accidental movements of the bell shaped plate radial to the axis of rotation.

8 Claims, 16 Drawing Sheets

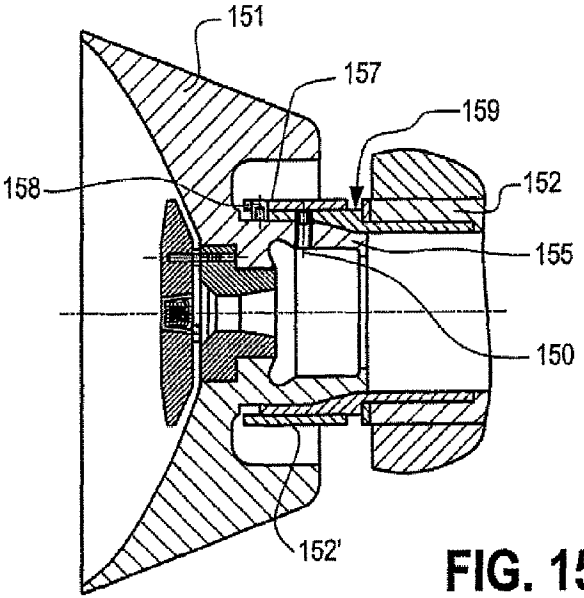
FIG. 15A
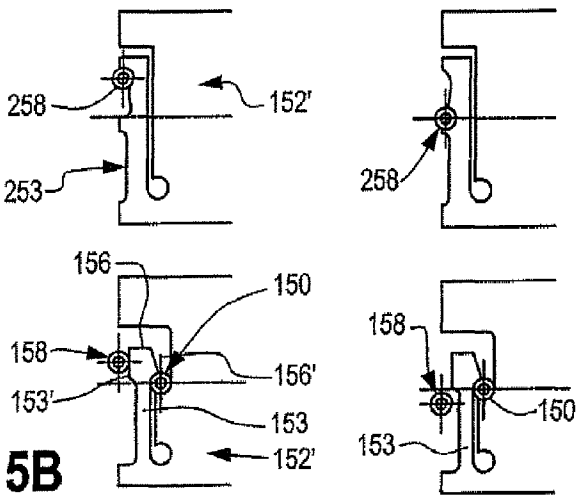
FIG. 15B
FIG. 15C
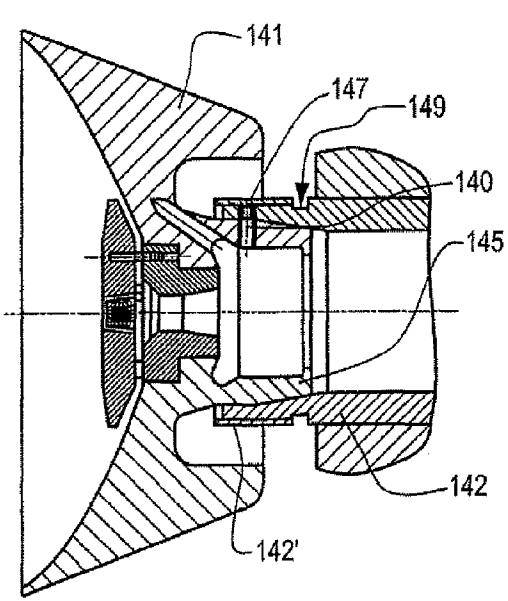
FIG. 14A
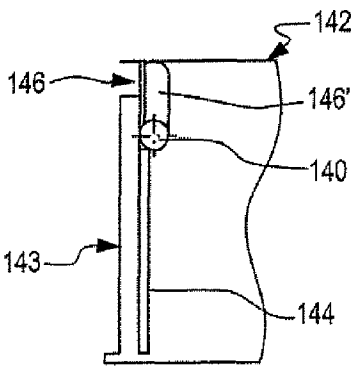
FIG. 14B

ROTARY ATOMIZER WITH A SPRAYING BODY

FIELD OF THE INVENTION

The present invention relates to a rotary sprayer for a coating apparatus, with a spraying body for the coating material, which spraying body rotates during the coating procedure and which can be mounted on the shaft of a drive motor. The present invention also relates to the preferably bell shaped spraying body as well as to the drive shaft of such a rotary sprayer.

BACKGROUND

The bell shaped plates of rotary sprayers are known and conventionally used for the automatic series production coating of work pieces i.e. (DE 43 06 799). Bell shaped plates can serve as spraying bodies, and can have an externally threaded cylindrical hub section that is manually screwed into the open front end of the hollow shaft of the drive motor. The drive motor can consist of an air turbine, and can be unscrewed, for example, for maintenance purposes or for installing a new bell shaped plate, while the hollow shaft can be appropriately locked i.e. (EP 1 245 290). Since, due to the high speeds of the air turbine, e.g., in the range of more than 50,000 rpm, this detachable mounting device requires that the bell shaped plate be accurately centered and balanced relative to the axis of the hollow shaft, the hub section of the bell shaped plate can include a conical part which lies against a matching conical area of the inside wall of the hollow shaft to form a centering cone. In contrast, the hub section of the bell shaped plate of other known rotary sprayers i.e. (EP 1 266 695) has an internal thread instead, by means of which internal thread the hub section is screwed onto an external thread at the end of the hollow shaft.

In addition to the centering and balancing requirement, the devices for mounting a bell shaped plate on its drive shaft must meet certain other requirements as well, such as tight fit for the reliable transmission of torques in both directions of rotation during acceleration and brake application, small space requirement, low risk of soiling, e.g., due to spray paint mist, easy cleaning, and last but not least, the possibility of rapid and easy mounting and dismounting.

The problem of the prior art rotary sprayers is that during malfunctions, the detachable mounting device can accidentally detach itself. Such accidents can have different causes, e.g., wear of the turbine, damage due to collision of the bell shaped plate with the work piece to be coated or due to inappropriate handling, imbalance of the bell shaped plate due to damage, faulty threading or soiling, etc., and can lead to a sudden abrupt brake application or seizing of the shaft. In the case of a screwed in or screwed on bell shaped plate, depending on the threading direction (right or left), the risk of an accidental detachment of the bell shaped plate may also arise during rapid acceleration of the bell shaped plate. In each case, it is possible for the bell shaped plate, which rotates at a high speed and which, because of its kinetic energy, can unscrew itself, to be flung from the sprayer, which can entail a considerable risk of damage and personal injuries.

To prevent the risk of the bell shaped plate being flung off, the European Patent EP 1 266 695 proposes after the threaded connection has been accidentally loosened, the bell shaped plate be caught by radial projections on the housing, against which the detached bell shaped plate abuts with radial projections of its hub section. The projections of the housing and the bell shaped plate can be twisted with respect to each other in a bayonet type fashion so that the bell shaped plate can be manually removed from and inserted into the sprayer. Since this design does not prevent the self acting complete unscrewing of the threaded connection, the detached bell shaped plate, which as a rule still has considerable kinetic energy and is moved by considerable out-of-balance forces, is able to damage not only the threaded connections but also any other parts of the bell shaped plate itself and of the sprayer.

SUMMARY

Thus, it is the objective of the present invention to connect the bell shaped plate or other rotating spraying bodies of rotary sprayers, in particular of modern high speed sprayers with especially high performance drive turbines, to the drive shaft such that on the one hand the spraying body can be relatively rapidly and easily mounted and dismounted, and on the other hand the abovementioned risks that might arise when the shaft seizes or the change in the speed is extreme are avoided. This problem is solved by the characteristics disclosed in the claims.

The invention makes it possible to avoid—reliably and simply, either completely or at least to a degree sufficient to avoid damage—an accidental detachment of mounting devices that meet the abovementioned requirements, e.g., provision of a centering cone, but that are not fail-safe, which is the case, e.g., with the threaded connections of conventional sprayers, the advantages of which can in principle be retained in embodiments of the present invention. The present invention, however, is not restricted to embodiments with threaded connections. Instead, means or measures according to the present invention for the prevention of an accidental self-release of the mounting device or at least of strong movements of the spraying body caused by out-of-balance forces radial to the axis of rotation can be implemented in many different ways, which will be explained based on the drawing in the embodiments of the invention described below.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein:

FIG. 14A-14B shows another embodiment with a bayonet catch, in two views;

FIG. 15A-15C shows a modification of the embodiment seen in FIG. 14 with a lock construction, in three views;

DETAILED DESCRIPTION

Figure 1:
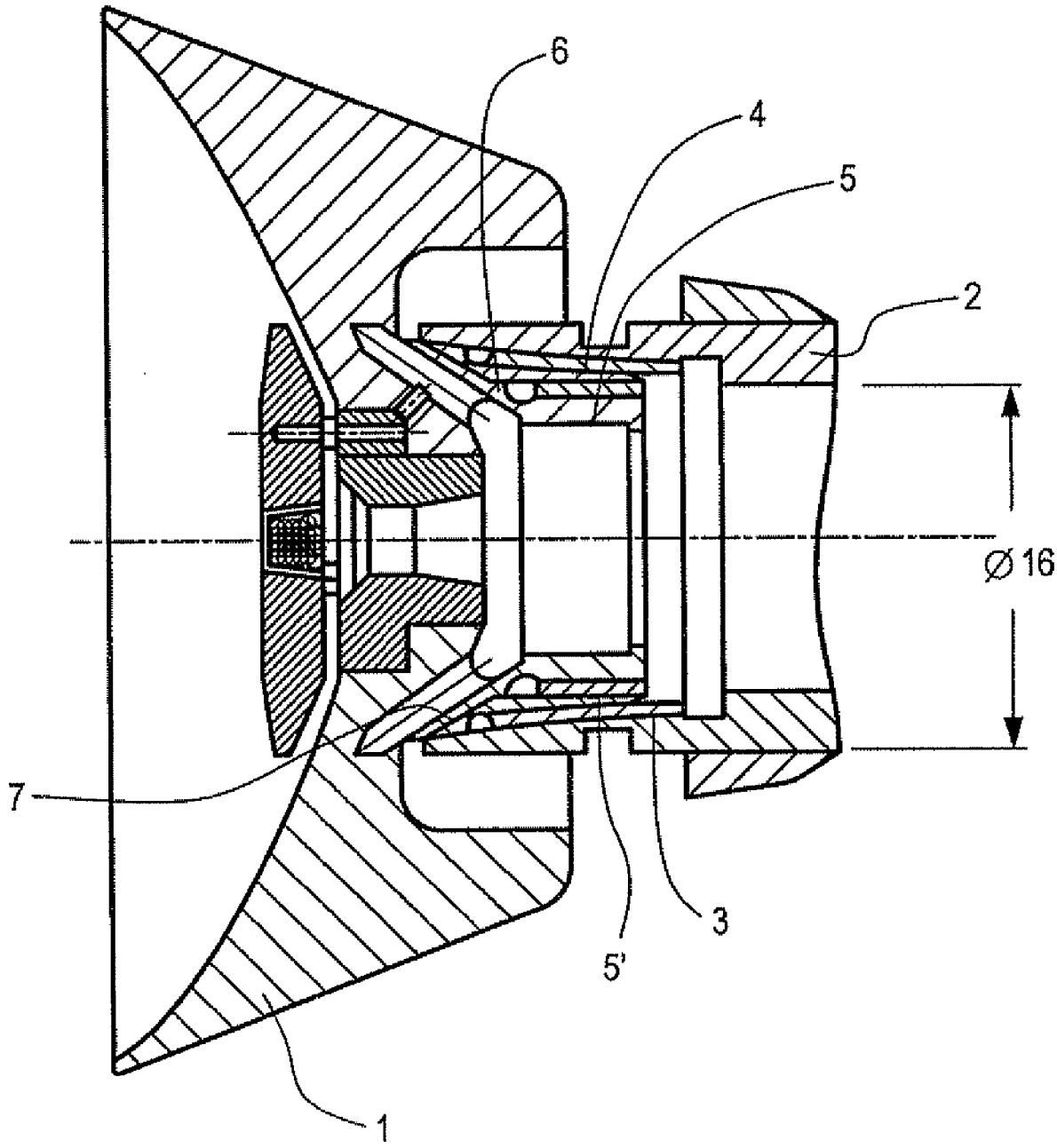
FIG. 1 shows the mounting device of a bell shaped plate in a first embodiment of the invention.

In the configuration shown in FIG. 1, the bell shaped plate 1 is mounted in the hollow shaft 2 of a high-speed sprayer, the hollow shaft being driven, for example, by an air turbine. To this end, shaft 2 has an internal thread 3 into which the external thread 4 on the cylindrical hub section 5 of the bell shaped plate 1 is screwed. To center the bell shaped plate 1, a cone-shaped section 6 of the bell shaped plate, which extends toward the front end of the bell shaped plate adjacent to the thread, lies against a matching conical inside surface 7 on the open front end of the hollow shaft 2. For replacement or maintenance purposes, the bell shaped plate 1 can be easily, e.g., manually, unscrewed from and just as easily be screwed into the shaft, even without a tool, provided that the shaft can be locked. The configuration shown is substantially rotationally symmetrical. As described so far, it is very similar to the conventional rotary sprayers, e.g., as in EP 0 715 869 [sic; 896] B1 and therefore requires no further explanation.

As conventionally designed, the part of the hub section 5 that is molded onto the bell shaped plate 1 to form a single piece could directly abut the inside wall of the hollow shaft 2, while in the embodiment shown in FIG. 1, a centering ring 5' having a shape that is conical at one end and cylindrical at the end of the thread is arranged between the molded on part and the hollow shaft, with the conical part of the hub section 5 lying against the conical inside surface of the centering ring, while its conical outside surface abuts the conical inside surface of the hollow shaft 2, which centering ring can, e.g., be screwed onto or be attached by other means to the molded on part of the hub section 5. The centering ring 5' can, however, also be mounted inside the end of the hollow shaft 2, thus making it possible to unscrew the bell shaped plate from the stationary centering ring 5'.

According to the invention described, however, the configuration shown differs from known constructions mainly in that it has a shrink fit between the bell shaped plate 1 and the hollow shaft 2. In the resting and operating state of the configuration shown, i.e., at room temperature, for example, the inside diameter of the hollow shaft (which, e.g., because of its conical shape, can change along the axial direction) is dimensioned throughout the area or at least at certain points of the cylindrical area at which the hub section 5 and its centering ring 5' lie against the inside wall of the hollow shaft 2 to be smaller than the outside diameter of the hub section 5 and 5' at the equivalent points along the axial direction when the bell shaped plate is mounted, such that these parts, when mounted, are undetachably connected to one another. Given an appropriate accuracy of fit, a difference between the diameters in the 1/100 mm range is, as a rule, sufficient. According to the present invention, this mounting device can then be loosened by means of heat application and the resultant radial expansion of the hollow shaft 2 which is conventionally made of metal, thereby making it possible for the bell shaped plate 1 to be easily unscrewed from the heated hollow shaft. Similarly, the hollow shaft is heated when the bell shaped plate is to be screwed into the open end of the hollow shaft. Heat can be easily applied, e.g., by placing electrically heated pliers onto the element to be heated. One possibility to achieve this purpose is the use of inductively acting pliers.

FIG. 1 merely serves to explain the embodiment of the present invention discussed when applied to a prior-art type of connection. Since it may be difficult and/or impracticable to heat the drive shaft of sprayers conventionally used in practice, in the embodiment under consideration the hub section of the bell shaped plate should preferably not be inserted into a hollow shaft; instead, the hub section should instead envelop the periphery of the drive shaft in the form of an outside component. By applying the induction pliers mentioned, the hub section of the bell shaped plate, which may be made, e.g., of a titanium material, can be easily grasped and radially expanded by means of heat application, and subsequently the bell shaped plate can be easily mounted onto and similarly easily dismounted from the drive shaft, which is possible without substantially heating the drive shaft, which is typically made of steel. Another difference between the embodiment shown in FIG. 1 and the embodiment of the present invention is that the bell shaped plate is preferably not screwed to the drive shaft. To ensure a secure and reliable shrink fit the cylindrical surfaces in contact with one another can be smooth, which makes it possible to mount and dismount the bell shaped plate considerably more rapidly as well as considerably more easily than before. Yet, if it were to be necessary in the interest of increasing safety, other form locking constructions that can be more rapidly dismounted and mounted than the threaded connection are conceivable. In principle, the shrink fit is suitable for any assembled connecting elements of the bell shaped plate and the drive shaft.

Figure 2:
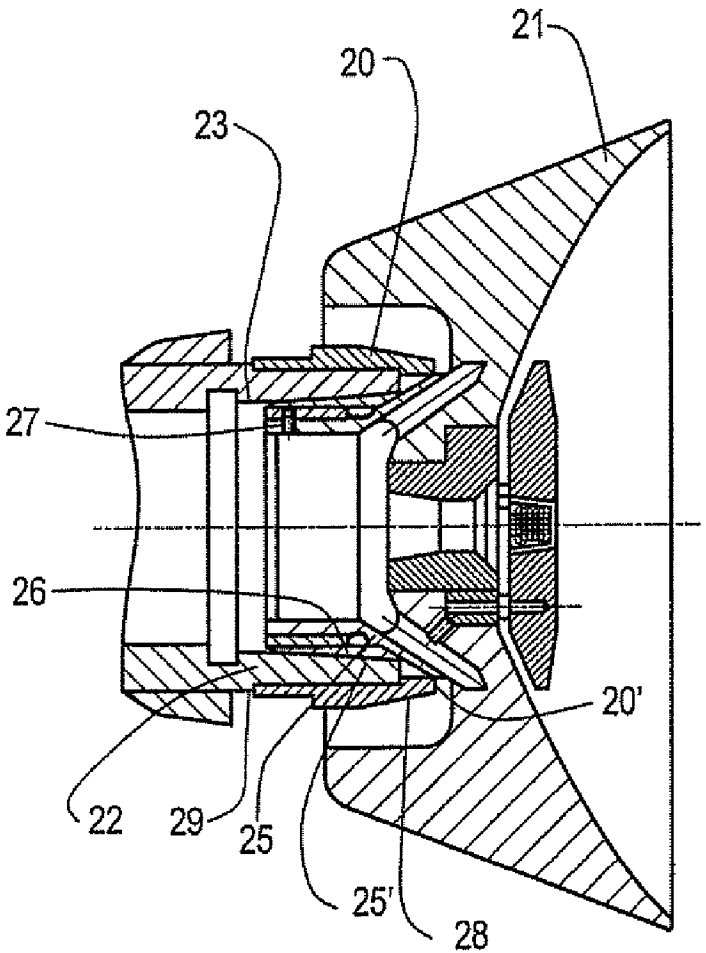
FIG. 2 shows an embodiment with a coupling nut for locking the bell shaped plate.

As in FIG. 1, the hub section 25 of the bell shaped plate 21 in the configuration shown in FIG. 2 is inserted into the conical end of the hollow shaft 22, with a centering ring 25' being arranged between them to form a centering cone. The hub section 25 and the centering ring 25' are connected to each other by means of at least two radial screws 27 that are distributed at uniform angular distances around the axis of rotation, the screws having heads that can be moved in a radial slot 23 in the inside wall of the hollow shaft 22, thereby ensuring that the radial screws 27 prevent a relative rotation between the bell shaped plate 21 and the hollow shaft 22. To lock the bell shaped plate 21 into position, a coupling nut 20 is used, which coupling nut is screwed onto an external thread of the hollow shaft 22 and, with rim 20' that projects inwardly at one of its ends, axially abuts a radially outwardly projecting rim 28 of the bell shaped plate or, in the example shown, of the centering ring 25'. By tightening the coupling nut 20, the nut pushes the centering cone of the bell shaped plate 21 against the conical inside surface 26 of the hollow shaft 22. With the bell shaped plate mounted, the opposite end of the coupling nut 20 can abut a stop edge 29 of the hollow shaft 22. To release the lock, the coupling nut 20 is unscrewed from the hollow shaft 22, which subsequently allows the bell shaped plate 21 to be pulled out of the hollow shaft. For all practical purposes, a self-acting release of the lock due to braking and accelerative forces acting on the bell shaped plate is precluded.

Locking into position by means of a coupling nut 20 can also be implemented without the radial screws 27. For example, in a manner similar to that in FIG. 1, the hub section 25 or the centering ring 25' could be screwed into an internal thread of the hollow shaft and could be unscrewed after removal of the coupling nut, in which case it is useful if the threads of the coupling nut and the hollow shaft run in opposite directions (right and left, respectively).

Figure 3A:
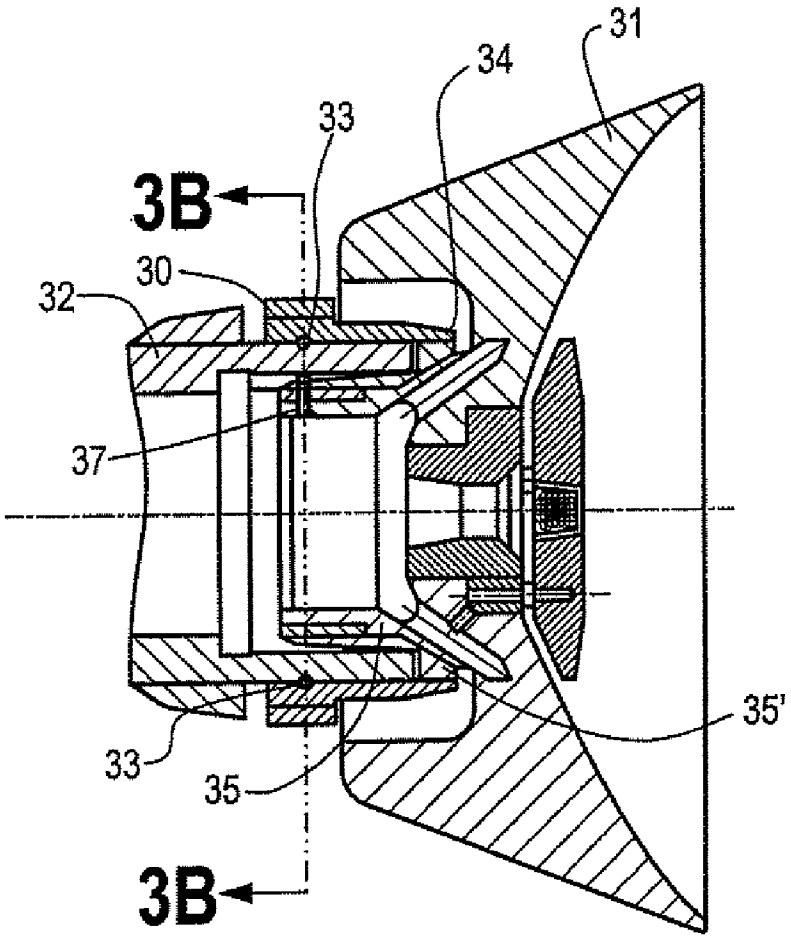
FIG. 3A shows another embodiment with a coupling nut.

FIG. 3A shows a modification of the embodiment seen in FIG. 2, with a coupling nut 30 which in this case is not screwed onto the hollow shaft 32 but onto an external thread 34 of the centering ring 35' (or of the hub section 25 or any other part of the bell shaped plate 31, if no separate centering ring is present).

Figure 3B:
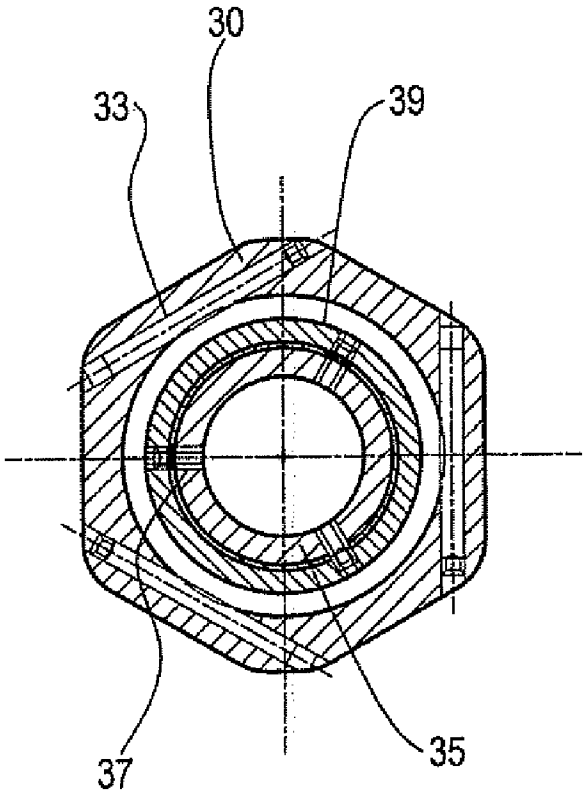
FIG. 3B shows a section through FIG. 3A along the plane 3B-3B.

Another feature is that an axial movement of the coupling nut 30 relative to the hollow shaft 32 is prevented by one or a plurality of locking members that are distributed at uniform angular distances around the axis of rotation, in the example shown by the locking screws 33 which are screwed tangentially in a common plane that intersects the axis of rotation at right angles into the coupling nut 30 and engage in an annular recess 39 in the outer circumference of the hollow shaft 32. The section view of FIG. 3B shows a useful shape and configuration of the arresting screws 33. The radial screws 37 are equivalent to screws 27 in FIG. 2.

In the embodiment shown in FIG. 4, again a coupling nut 40 is used to lock the bell shaped plate 41 into position. One end of the coupling nut is screwed onto the hollow shaft 42, and the other end with a radially inwardly projecting rim 40' engages the bell shaped plate 41 via an intermediate element. In the embodiment shown, the intermediate element is an elastic clasping system that is molded onto the end of a hollow shaft 42, the end section 48 of which clasping system is pressed in the manner of clip pliers from rim 40' of the coupling nut axially in the direction of the hollow shaft 42 against a stop surface 49 on the circumference of the hub section 45 of the bell shaped plate 41 when the bell shaped plate is in the mounted position. Thus, when the coupling nut 40 is tightened, for example, by means of an open-ended wrench, the conical section 46 of the bell shaped plate is pressed against the conical inside surface 47 of the hollow shaft 42, in similar fashion to the embodiments of FIG. 2 and FIG. 3. After releasing this threaded connection, the bell shaped plate can be easily pulled out of the hollow shaft, with the radially elastic terminal sections 48 of the clasping system being pushed radially outwardly by surface 49 of the bell shaped plate. The clasping system with the terminal sections 48, which, as the figure shows, are radially thickened, can be formed by an annular projection of the hollow shaft 42 which is relatively thin in the adjacent bridge like section or by separate axially projecting clasping tongues. Instead of being molding to the hollow shaft itself the clasping system can also be molded onto a separate component that is mounted on the hollow shaft.

According to another embodiment (not shown), a bell shaped plate, for example, identical to the one in FIG. 1, i.e., one that is screwed into a hollow shaft according to prior art practices, can be locked into position using an additional coupling nut. The coupling nut can be easily screwed onto an external thread on the end of the hollow shaft, which external thread is axially slotted for this specific purpose, so that the slotted end is clamped into position on the hub section of the bell shaped plate. The slotted end of the shaft could be clamped into position by means of a coupling nut or by means of a threadless coupling sleeve or sliding sleeve which is screwed or pushed against a limit stop on the bell shaped plate.

In another embodiment (also not shown), the bell shaped plate can be locked into position in or on the drive shaft, for example, by means of spherical elements which are arranged in recesses or in an annular groove on the outside surface of the inside element (the hub of the bell shaped plate or the shaft) and which, during operation and when the bell shaped plate is rotating, are pushed outwardly by the centrifugal force and into a position in corresponding recesses of the outside element where they prevent the axial movement of the two elements relative to each other. This connection can be locked into position by means of a screwed on coupling nut or a coupling sleeve under spring tension. The attached coupling sleeve may also be held in position by means of a bayonet catch that can be made to catch or be released by means of turning it.

Figure 5:
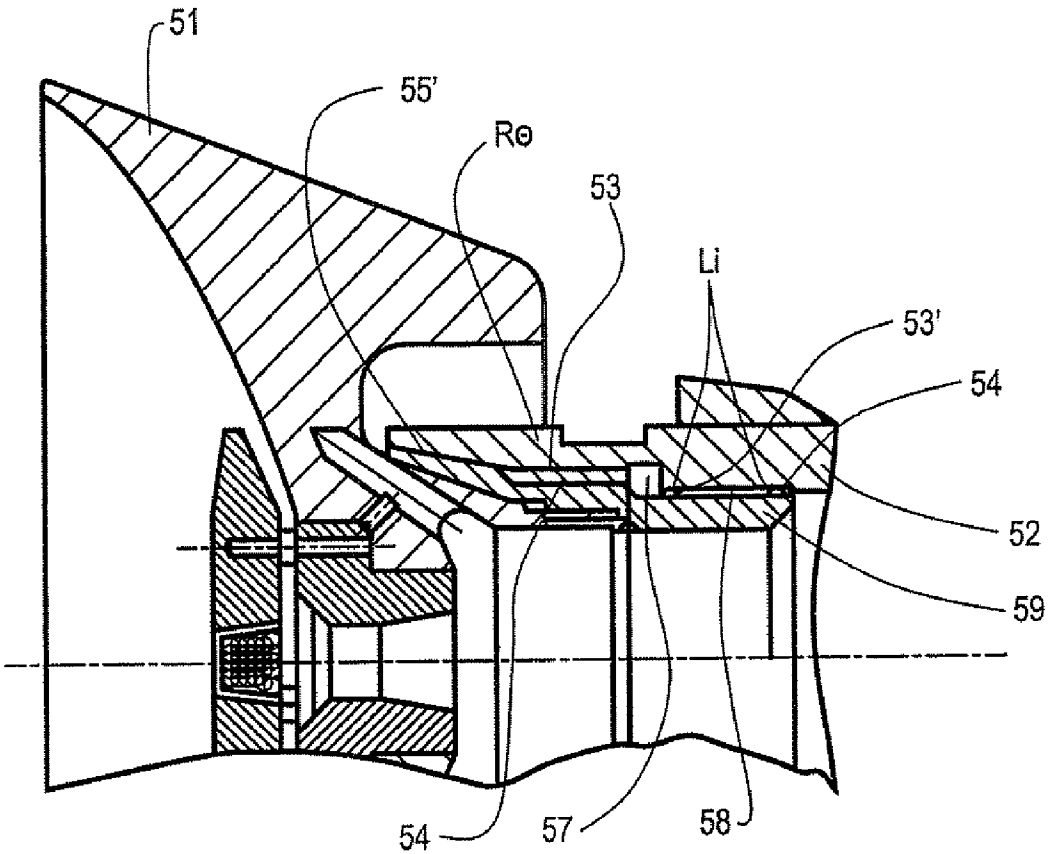
FIG. 5 shows an embodiment with a double thread.

In similar fashion to FIG. 1, the hub section 55 of the bell shaped plate 51 in the embodiment shown in FIG. 5, with the external thread 54 of the screwed on centering ring 55', is screwed into a first internal thread 53 of the hollow shaft 52 of approximately the same length. In this case, however, the hollow shaft 52 has a second internal thread 53' at an axial distance from thread 53 in the axial direction opposite to that of the bell shaped plate, which second internal thread, as illustrated, may be shorter than the first thread 53 and which has a smaller diameter. Arranged in the inside wall of the hollow shaft 52 between the two threads 53 and 53' is an axially relatively short annular recess 57, the radial diameter of which is slightly larger than that of the external thread 54, while on the surface of the second thread 53' facing away from the bell shaped plate, another annular or torus-like recess 58 extends along the cylindrical inside wall of the shaft, the axial length of which annular or torus-like perforation is slightly longer than the length of threads 53 and 54.

As illustrated, the mounted position of the bell shaped plate, in similar fashion to the other embodiments, is defined by the contact that the centering cone of the bell shaped plate makes with the conical inside wall of the hollow shaft. In this mounted position, the cylindrical terminal section 59 of the centering ring 55' of the bell shaped plate 51, in the direction facing away from the bell shaped plate, extends far enough into the hollow shaft 52 so that it reaches the axial end of the second recess 58. In the vicinity of this axial end, the terminal section 59, as illustrated, has a second axially relatively short external thread 54', the diameter and shape of which match the similarly short internal thread 53' of the hollow shaft 52. The outside diameter of thread 54', with small clearance, is approximately identical to the diameter of the cylindrical recess 58 so that thread 54' can be easily moved into the recess when the bell shaped plate is screwed in or unscrewed. When the bell shaped plate is mounted, the axial distance between threads 53' and 54' is slightly larger than the axial length of threads 53 and 54. Threads 53', 54' preferably run in opposite directions to threads 53, 54, i.e., they are left hand threads if threads 53, 54 are right hand threads. The advantage, in addition to increased security against a self acting detachment of the bell shaped plate, is that the threads are less able to become jammed or seized.

To dismount the bell shaped plate 51, it is first completely unscrewed from the first internal thread 53 of the hollow shaft 52; in the course of this, its second external thread 54' in recess 58 is pushed close to the second internal thread 53'. Next, to dismount it, the bell shaped plate, with its second external thread 54', is unscrewed in the opposite screwing direction from the second internal thread 53. To mount the bell shaped plate, the reverse sequence is used.

Thus, even if during operation the bell shaped plate 51 were to accidentally unscrew itself from the conventional thread 53, 54, the risk of its being flung is reliably prevented in that the second external thread 54' immediately strikes against the second internal thread 53'. Even in cases of a potential modification in which the two threads run in the same thread direction, this risk would still be considerably reduced. In addition, because of the described manner in which thread 54' is guided in the cylindrical recess 58, which enables a nearly clearance free radial support of the hub section of the bell shaped plate in the hollow shaft while and after the thread is unscrewed from the first thread 53, 54, the risk of damage to the components of the bell shaped plate in the hollow shaft due to out-of-balance movements in the radial direction is reliably avoided. To this end, the distance between threads 53' and 54' in the mounted position of the bell shaped plate can be dimensioned to ensure that, after thread 54 of the bell shaped plate has just detached itself from thread 53 while the bell shaped plate is being unscrewed, only the small minimum distance remains between threads 53' and 54' necessary for easily screwing thread 54' into thread 53' when the bell shaped plate is dismounted or mounted. Another advantage is that the screwing steps can be carried out manually or, if necessary, with a simple tool.

The embodiment illustrated in FIG. 5 can be modified in that the short second threads 53', 54' are replaced with a different type of a limit stop design with a similar mode of action. For example, instead of thread 53', it is possible to provide for separate radially inwardly projecting pins in the hollow shaft, which pins, during the mounting of the bell shaped plate, can be pushed through corresponding slots in a limit stop ring on the hub of the bell shaped plate, which limit stop ring is used in lieu of thread 54'.

Furthermore, it is also possible to insert an additional locking element, e.g., a molded spring washer, between the two threads.

Figure 6:
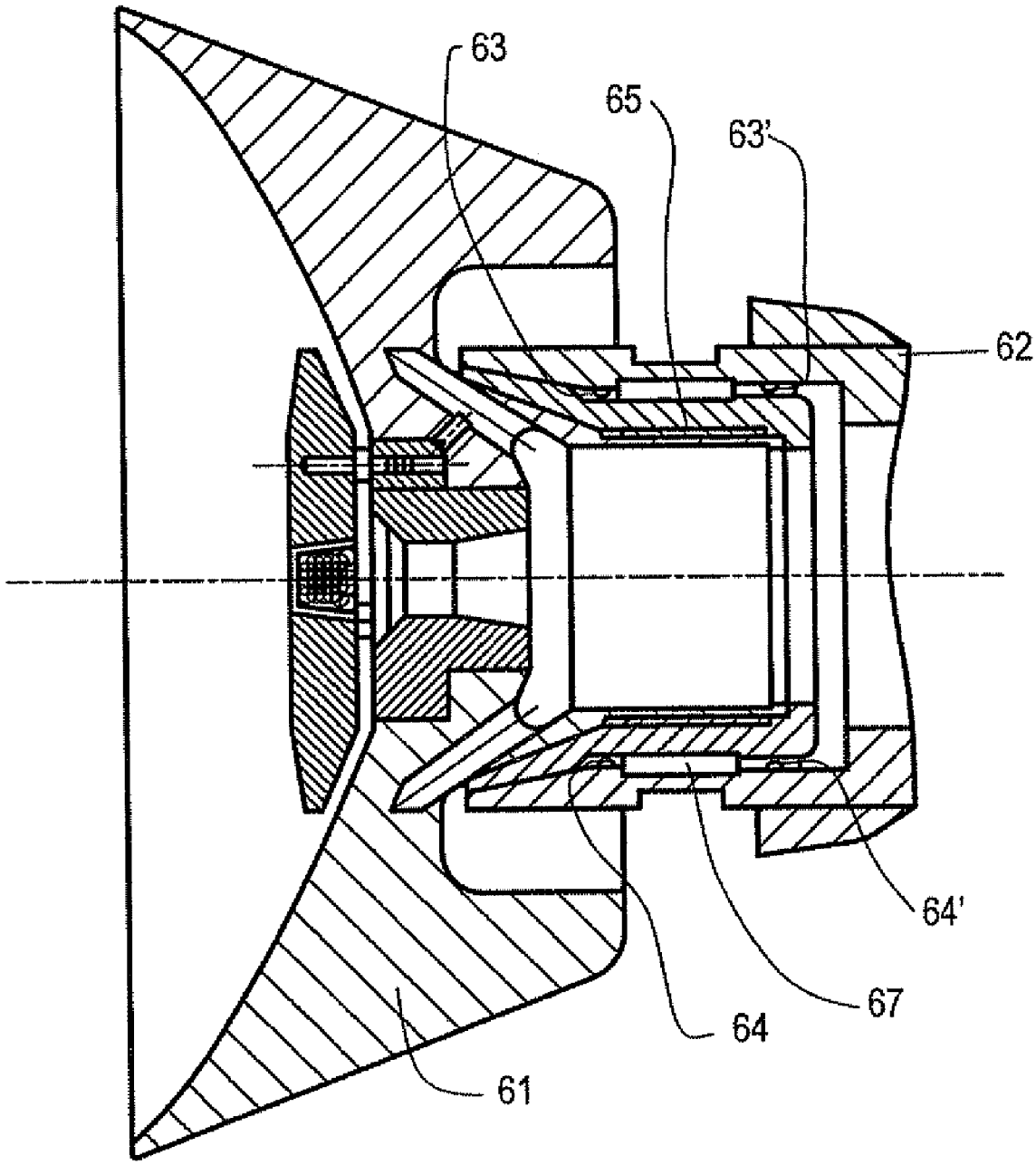
FIG. 6 shows another embodiment with a double thread.

The embodiment according to FIG. 5 may also be modified in the manner shown in FIG. 6. In this case, the hollow shaft 62 has two internal threads 63 and 63' running in the same direction (e.g., right-handed threads) and having the same outside diameter, the threads being axially distanced from each other by the annular groove-type recess 67. When the bell shaped plate 61 is in the mounted position, the internal thread 63' that faces away from the bell shaped plate mates with the external thread 64 of the bell shaped plate or with its centering ring 66. In this particular embodiment, thread 63' which faces away from the bell shaped plate may be longer than thread 63. In similar fashion to FIG. 5, the length of the recess 67, and thus the distance between the threads is dimensioned just large enough to ensure that when the bell shaped plate is unscrewed from the internal thread 63', only a minimum distance necessary to subsequently allow threads 64 and 63 to mate easily remains between the external thread 64 and the internal thread 63. This embodiment has advantages similar to those of the embodiment illustrated in FIG. 5.

Figure 7B:
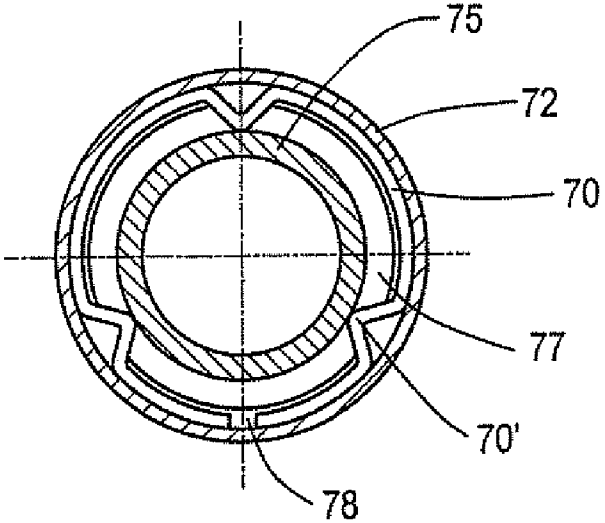
FIG. 7B shows a section through FIG. 7A along the plane 7B-7B.
Figure 7A:
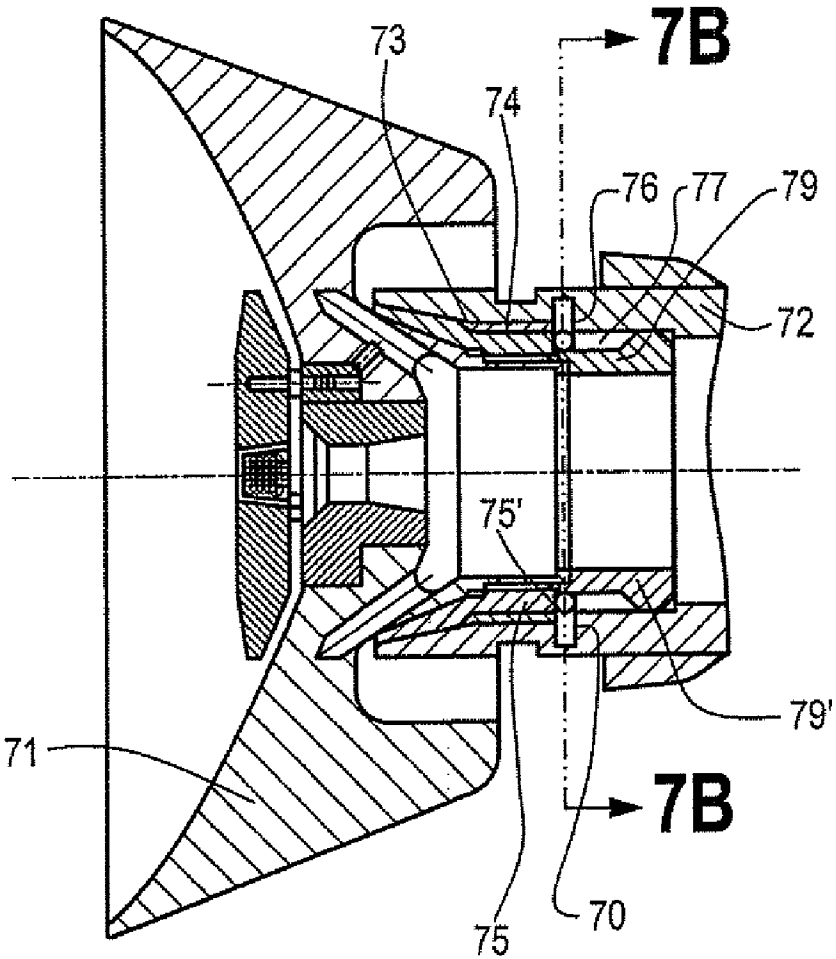
FIG. 7A shows an embodiment with a molded spring washer that locks the bell shaped plate into the hollow shaft.

Another embodiment with a limit stop design and advantages similar to those of FIG. 5 and FIG. 6 is illustrated in FIG. 7A. Again, in similar fashion to FIG. 1, the bell shaped plate 71, along with the external thread 74 of the centering ring 75, is screwed into the internal thread 73 of the hollow shaft 72. In similar fashion to FIG. 5, the centering ring 75 has a cylindrical terminal section 79 which extends into the hollow shaft 72. As illustrated, in its peripheral area, the terminal section has an annular recess or a cylindrical annular groove 77 which, on the surface facing away from the bell shaped plate 71, is bounded by an end ring 79' which has the illustrated shape, which in cross section is conical, with front faces that slope radially outward [sic] in the direction of the center of the ring. The outside diameter of the end ring 79' is slightly smaller than that of the external thread 74, thus making it possible to push it through the internal thread 73 of the hollow shaft. On the opposite side, the annular groove 77 is instead bounded by a shoulder 75', located on the periphery of the centering ring 75 and bordering thread 74. In the region of the annular groove 77, the inside diameter of the hollow shaft 72 is approximately identical to the outside diameter of the end ring 79', thus ensuring that in this region, the end ring can be axially moved and guided, with at most a small radial clearance, through the hollow shaft.

In the mounted state of the bell shaped plate, an annular groove 76 arranged in the inside wall of the hollow shaft 72, in which groove a molded spring washer 70 is undetachably arranged, is aligned with shoulder 75'. The molded spring washer 70 may have the shape illustrated, e.g., in FIG. 7B, with protrusions or wavelike sections 70' that project radially inward up to the cylindrical periphery of the annular groove 77 of the terminal section 79 of the bell shaped plate. To ensure that the molded spring washer 70 can be easily inserted into the annular groove 76 and allows radial movements of its wavelike sections, the molded spring washer does not form a closed ring but instead has a gap designated by reference numeral 78. The shape and configuration of the wavelike sections 70' may be such that the molded spring washer 70 is balanced and does not generate out-of-balance forces.

When the bell shaped plate 71 is unscrewed so that it can be dismounted from the hollow shaft 72 or if it accidentally unscrews itself, i.e. as soon as threads 73 and 74 have become disengaged, first the end ring 79' of the bell shaped plate and/or of its centering ring 75 strikes (in principle similarly to the embodiments of FIGS. 5 and 6) against the radial protrusions, i.e., the wavelike sections 70' of the molded spring washer 70, The length of the annular groove 77 can be dimensioned to ensure that after release of the threaded connection, no substantial space remains between the end ring 79; and the radial plane of the molded spring washer 70 on its side facing away from the bell shaped plate. Because of the design described, if the molded spring washer 70 is appropriately dimensioned, the bell shaped plate cannot be accidentally flung from the hollow shaft, and the guideway of the end ring 79' along the inside wall of the hollow shaft 72 prevents even radial movements of the bell shaped plate that could generate out-of-balance forces. After release of the threaded connection, on the other hand, the bell shaped plate can be easily and intentionally removed from and reinserted into the hollow shaft since, given the axial force, the slanting flanks of the end ring 79' are able to push the protrusions or wavelike sections 70' outwardly into the annular groove 77. On the other hand, if the bell shaped plate becomes accidentally unscrewed, such axial forces cannot be generated.

The embodiment according to FIG. 7 can be modified in that limit stop designs other than the molded spring washer 70 and the end ring 79' are provided, for example, with radially inwardly or outwardly projecting projections or pins.

Also conceivable are embodiments (not shown) in which the bell shaped plate with its hub section is slidable on or in the drive shaft, i.e., is not screwed into or onto the drive shaft, and in which only a molded spring washer that is inserted between the bell shaped plate and the shaft in one annular groove each is provided to lock the bell shaped plate into position, for example, similarly to the molded spring washer 70 described in FIG. 7.

In the embodiments of the present invention in which a retaining ring is used, it is useful for the ring to be saw-toothed.

Figure 4:
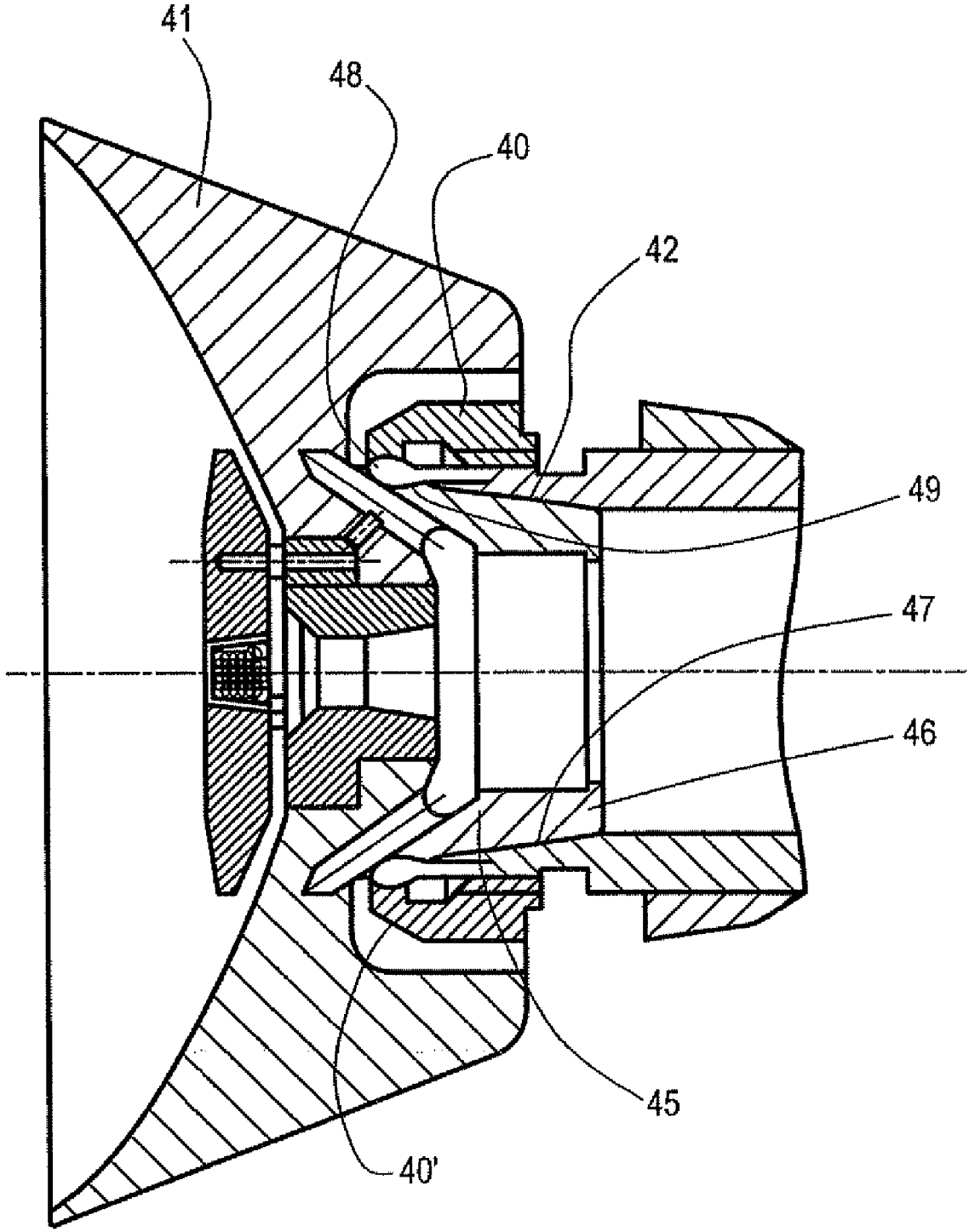
FIG. 4 shows yet another embodiment with a coupling nut.
Figure 8:
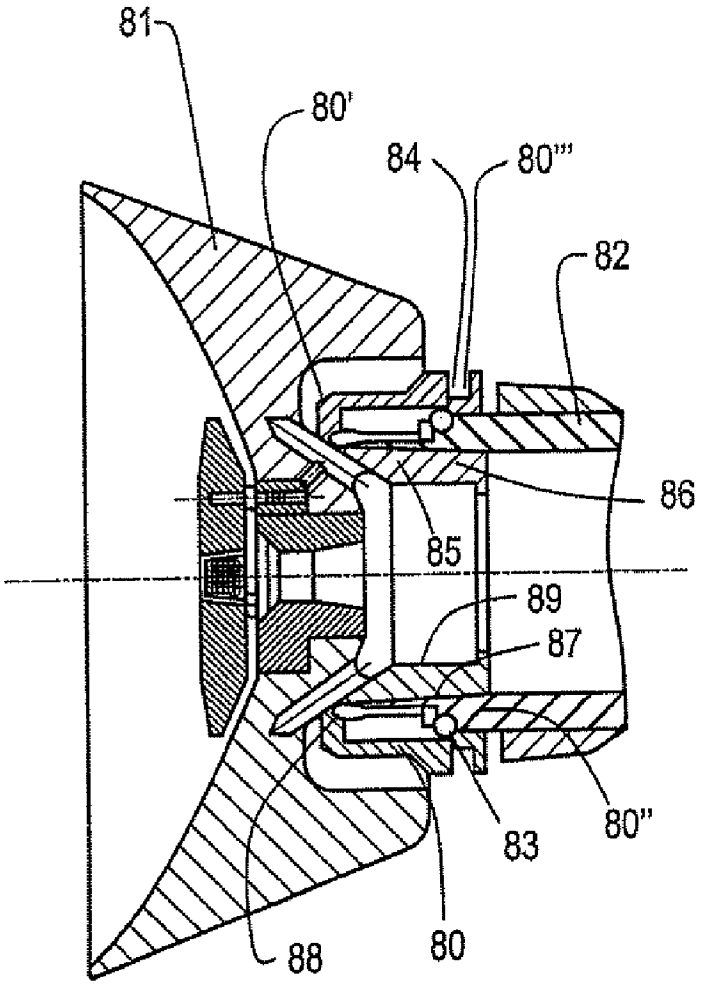
FIG. 8 shows an embodiment of the invention with an O ring.

FIG. 8 shows an embodiment with a bell shaped plate 81 which, to center it, has the conical section 86 of its hub section 85 lie against the corresponding conical inside surface 87 of a hollow shaft 82, at the end of which, in similar fashion to the embodiment of FIG. 4, an elastic clasping system with terminal sections 88 which, in the manner of tabs, project radially inward is molded on (or is attached as a separate component). The tab-like terminal sections 88 of shaft 82 are pushed by the radially inwardly projecting end rim 80' of a coupling sleeve 80, comparable to the coupling nut in FIG. 4, against the limit stop surface 89 on the periphery of the hub section 85. As illustrated, the coupling sleeve with its smooth cylindrical inside surface 80", the inside surface being axially opposite to the end rim 80', is axially located on the periphery of the hollow shaft 82, for example, in the region of or vicinity of the conical area 87. In contrast to FIG. 4, the coupling sleeve 80 is not screwed onto the hollow shaft 82 but secured on it only by means of an O-ring 83 which may be made of an appropriate synthetic rubber elastic material. As illustrated, the O-ring 83 can be inserted into an annular groove in the outer periphery of the hollow shaft 82 so that, on the inside surface of the coupling sleeve 80, it pushes against a radial or slanting limit stop surface 84 facing it. To release the connection between the bell shaped plate 81 and the hollow shaft 82, the coupling sleeve 80 is moved, while overcoming the frictional force of the O-ring 83, far enough along shaft 82 that its end rim 80' releases the terminal sections 88 of the shaft, using, if necessary, a removal tool that is inserted into the recess 80'" in the outside surface of the sleeve 80. The bell shaped plate can subsequently push the terminal sections 88 radially aside, thereby allowing it to be pulled off the shaft. The reverse sequence is used to mount the bell shaped plate.

Figure 9:
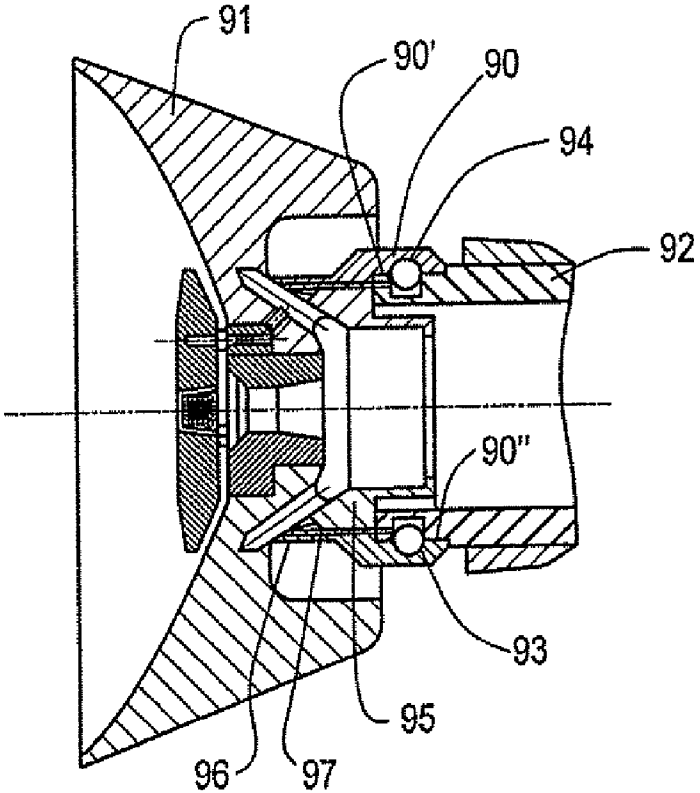
FIG. 9 shows another embodiment with an O ring.

Another embodiment with an elastic O-ring 93 that serves to lock the bell shaped plate 91 into position on shaft 92 is illustrated in FIG. 9. As in FIG. 8, the O-ring can be arranged in an annular groove in the outside surface of shaft 92 and push against the radial or slanting limit stop surface 94 of an annular groove 90' in the smooth cylindrical inside surface 90" of a coupling sleeve 90, the smooth cylindrical inside surface being seated on the periphery of the shaft. This embodiment differs from that shown in FIG. 8 mainly in that the clasping system at the end of the shaft is absent and that the coupling sleeve 90 is mounted by means of a threaded connection or other connection that cannot detach itself on the hub section 95 of the bell shaped plate. To center the bell shaped plate 91, the bell shaped plate abuts with the conical section 96 of its hub section 95 against the corresponding conical inside surface 97 on the end of the coupling sleeve 90. Since in this embodiment, the bell shaped plate 91 is held on shaft 92 solely by the initial tension and friction of the O-ring 93, the bell shaped plate can be dismounted even more rapidly and more easily and mounted just as rapidly and easily. An additional advantage of the separate coupling sleeve is that the bell shaped plate itself can be more simply designed and more easily manufactured.

Another possibility (not shown) is a clasping system in which a molded clip component made, e.g., of a plastic material, is attached by means of a threaded connection to the bell shaped plate which preferably has the conventional centering cone. To attach the bell shaped plate, this molded clip component can subsequently be clipped into a correspondingly designed receiving element of the hollow shaft.

Figure 10:
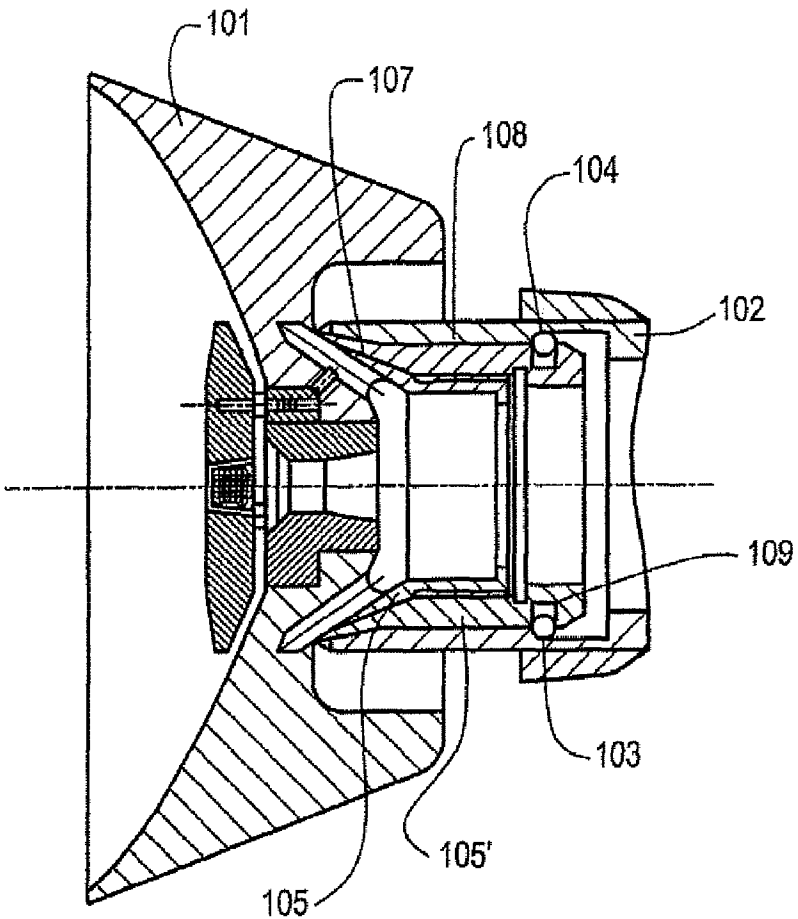
FIG. 10 shows an embodiment of the invention with a snap ring.

FIG. 10 shows a modification of the embodiment of FIG. 9 in which the bell shaped plate 101 with its hub section 105 and the centering ring 105' thereof can again be easily inserted into and removed from the hollow shaft 102. As illustrated, the centering ring 105', with its smooth peripheral surface, abuts the conical inside surface 107 and the neighboring cylindrical inside surface 108 of the hollow shaft, and serves a purpose similar to that of the centering rings of the embodiment already described, i.e., it simplifies the bell shaped plate itself to the hub section 105 of which it is detachably mounted but not so that it can become detached by itself. To lock the bell shaped plate into position on the shaft, this embodiment uses, e.g., a metal snap ring 103 instead of the rubber elastic O-ring according to FIG. 9. As illustrated, the snap ring 103 can be inserted into an annular groove 109 in the outside surface of the centering ring 105' and, projecting radially from its surface facing the bell shaped plate, strike against a radial or slanting limit stop surface 104 facing away from the bell shaped plate in the inside surface 108 of the hollow shaft 102, thereby preventing the bell shaped plate from accidentally slipping out of the hollow shaft. To release the connection, the snap ring 103 can be compressed by means of a tool or, given an appropriate axial force, by the limit stop surface 104 which is slanted specifically for this purpose, and can thus be pushed into the annular groove 109, while during mounting, i.e., during insertion into the hollow shaft, it is compressed by the inside surface 108 before it engages behind the limit stop surface 104. This means that the bell shaped plate is held in position in the hollow shaft solely by the snap ring. Notwithstanding the gap in the ring, the snap ring should be balanced to avoid out-of-balance forces.

Figure 11:
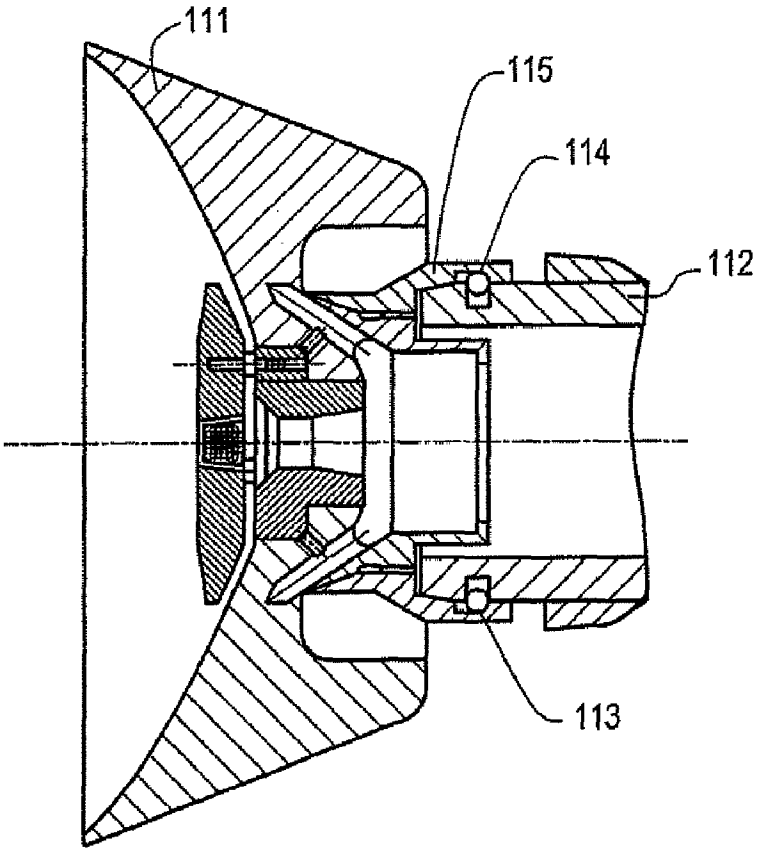
FIG. 11 shows another embodiment with a snap ring.

FIG. 11 shows another embodiment with a snap ring 113 as the sole locking element, with the snap ring in this case not lying against the inside surface of the hollow shaft 112 but instead being arranged in an annular groove 119 in the outside surface of the hollow shaft 112. With the part that projects radially from the annular groove 119, the snap ring 113 strikes against a radial or slanted limit stop surface 114 facing the bell shaped plate 111 in the inside surface of a centering ring 115 which in principle corresponds to the centering ring 105' in FIG. 10 but which, as illustrated, encloses the outer surface of the hollow shaft 112. The bell shaped plate is mounted and dismounted in a manner similar to that described in the embodiment according to FIG. 10.

Figure 12C:
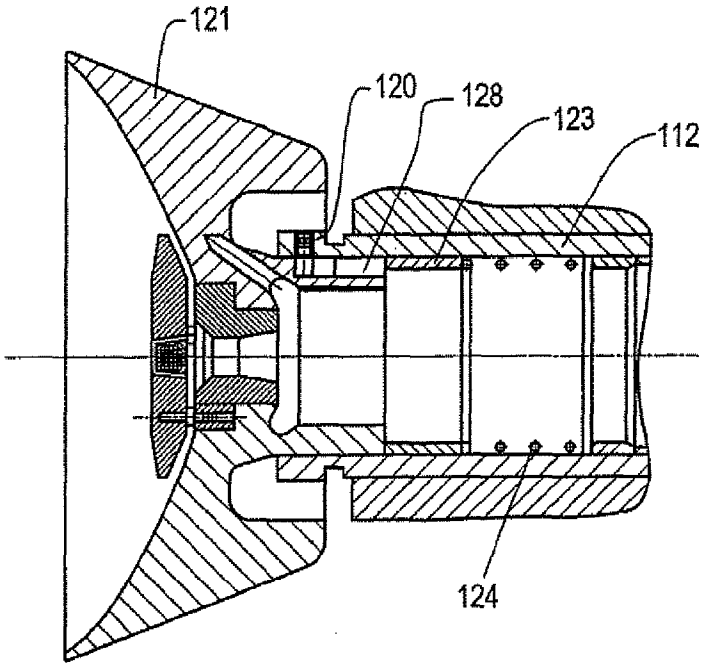
FIG. 12A-12C shows an embodiment with a bayonet catch in three views.
Figure 12A:
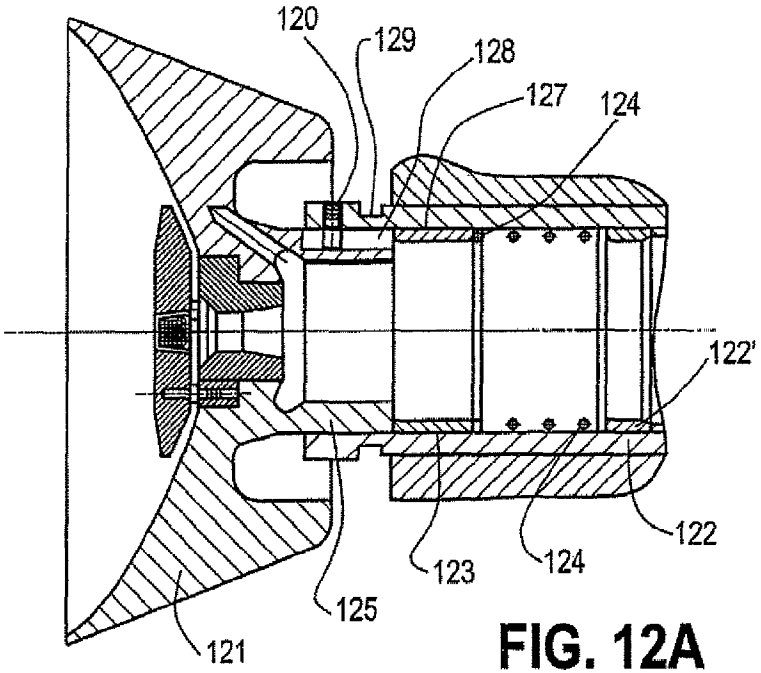

In the embodiment of the invention shown in FIG. 12A, the smooth peripheral surface of the cylindrical hub section 125 of the bell shaped plate 121 abuts the smooth cylindrical inside surface 127 of the hollow shaft 122. On its radially projecting terminal area 125' on the shaft side, the hub section 125 of the bell shaped plate strikes against the axial rim of an axially movable cylindrical annular body 123 that rests against the inside surface 127 of the hollow shaft, which annular body, on its axially opposite side, pushes against a spiral spring 124 that is also arranged coaxially in the hollow shaft 122. On its end facing away from the bell shaped plate, the spiral spring 124 in turn bears against an annular element 122' that is mounted in the hollow shaft (or formed by the hollow shaft).

Figure 12B:
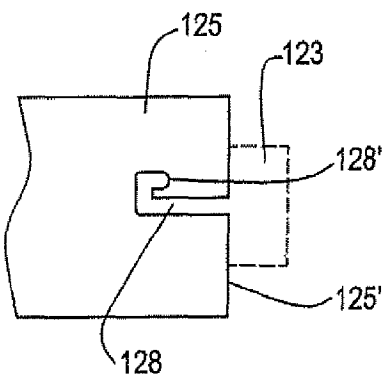

To mount the bell shaped plate 121 in the hollow shaft 122, this embodiment uses a bayonet catch. The lock is formed by a threaded bolt or other pin 120 which is mounted in the wall of the hollow shaft and which, radially projecting inwardly from surface 127, engages in a slot 128 that is molded into the outer surface of the hub section 125 of the bell shaped plate. The shape of the slot 128 can be seen in FIG. 12B in which the hub section 125 and the annular body 123 are shown schematically. Thus, slot 128 extends from the end, which is axially open toward the outside, in the terminal area 125' of the hub section 125 axially inwardly up to the U-shaped part and ends at the axially closed end 128' of the second U-shaped leg. In the working position shown in FIG. 12A, the bell shaped plate 121 is pushed by the elastic force of the pressure spring 124 by way of the annular body 123 against the pin 120 that lies against the slot end 128' of the bell shaped plate, and is thus axially locked into position in the shaft. To release this lock, the bell shaped plate 121 is pushed into hollow shaft 122 against the force of spring 124 until the bell shaped plate reaches the dismounting position shown in FIG. 12C, in which pin 120 strikes against the axially inside end of the molded slot 128. After the bell shaped plate has been rotated so that pin 120 is located in the axially open U-shaped leg of the molded slot 128, the bell shaped plate can be easily pulled out of the bell shaped plate. Mounting is just as easy, except that the reverse sequence is used. A tool can be inserted into the recesses 129 of the shaft to lock the hollow shaft 122 into position while the bell shaped plate is mounted and dismounted.

Although the drawing shows only one pin 120, it is preferable to distribute at least two or more pins 120 and slots 128 at uniform angular distances around the axis of rotation to ensure that no out-of-balance forces are generated.

Instead of mounting the bayonet catching pins in the shaft, a modification of this embodiment provides that they be mounted in the hub section of the bell shaped plate and be inserted into the molded slots of the shaft.

Figure 13C:
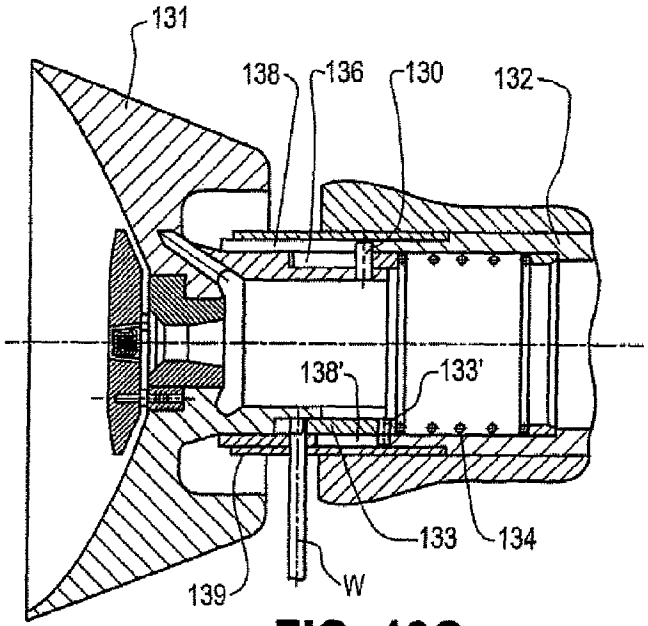
FIG. 13A-13D shows a modified embodiment with a bayonet catch and an additional lock construction, in four views.
Figure 13D:
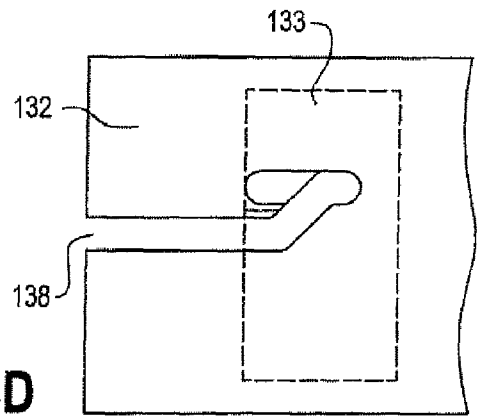
Figure 13A:
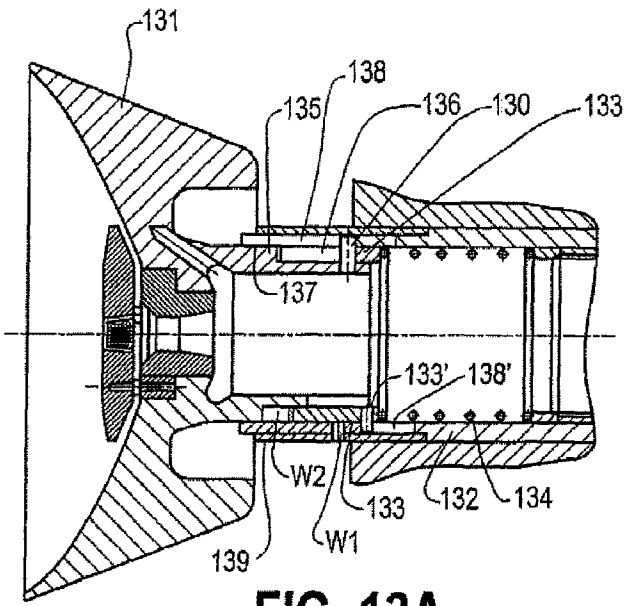
Figure 13B:
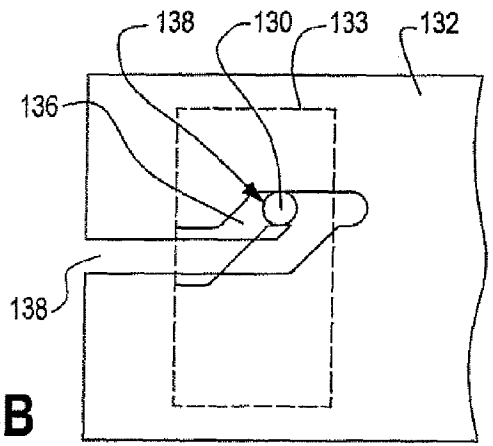

In similar fashion to FIG. 12, the bell shaped plate 131 in the embodiment shown in FIG. 13A, with its hub section 135 resting without threaded connection against the smooth inside surface 137 of the hollow shaft 132, is axially movably positioned in and attached to the hollow shaft by means of a bayonet catch which in this example has an additional lock. The bayonet catch construction comprises one, two or more pins 130 which are distributed around the axis of rotation to avoid out-of-balance forces and which, as illustrated, are mounted in the hub section 135 of the bell shaped plate, project radially outward, and are guided in two radially adjacent molded slots 136 and 138. The radially outward molded slot 138 is arranged in the cylindrical wall of the hollow shaft 132 and runs from the bell shaped-plate end axially inwardly, and subsequently, as seen in FIG. 13B, in the peripheral direction, and finally axially back to a limit stop surface, against which pin 130 in FIG. 13B abuts. The radially inner molded slot 136, on the other hand, is arranged in a cylindrical annular body 133 which, in similar fashion to FIG. 12, can be axially moved in the hollow shaft against the force of a spiral pressure spring 134 which bears at its opposite end against a shoulder or an annular element of the hollow shaft. Slot 136 runs from the bell shaped-plate end of the annular body 133 axially inward. Relative to the bell shaped plate, the annular body 133 is movably inserted into an annular recess on the periphery of the hub section 135, with the cylindrical outside surfaces of the annular body 133 and the hub section 135 which correspond to the inside diameter of the hollow shaft 132 being aligned relative to one another. In the annular body 133, one or preferably a plurality of additional pins 133' are mounted that are distributed around the axis of rotation, and these pins, which project radially outward, can be moved in axial slots 138' of the hollow shaft 132 and implement the additional locking function. Slots 136, 138 and 138' can be closed in the radially outward direction by a cover ring 139 that is attached to the hollow shaft.

The shape of slots 136 and 138 can be seen in the schematic representations of FIGS. 13B and 13D. In the working position of the bell shaped plate 131 shown in FIG. 13A and FIG. 13B, the spiral spring 134 pushes pin 133' by way of the annular body 133 against the radially extending limit stop surface of the hollow shaft 132 on the bell shaped-plate end of its slot 138', and pin 130 of the bell shaped plate against the radially extending limit stop surface on the bell shaped-plate end of slot 138 (see FIG. 13B), which locks the bell shaped plate that is connected to the annular body 133 into position in the shaft.

To release the connection, the bell shaped plate is pushed into the hollow shaft 132 against the force of spring 134, so that it reaches the dismounting position shown in FIG. 13C and FIG. 13D, in which pin 133' of the annular body 133 now strikes against the radially extending limit stop surface at the end of slot 138', the end remote from the bell shaped plate, and pin 130 strikes against the corresponding axial end of the molded slot 138 and the terminal sections of the molded slots 136 and 138 remote from the bell shaped plate are aligned relative to each other. This dismounting position can be locked into position by means of a tool W which is inserted through the openings in the hollow shaft and in its cover ring 139 and hub section 135, and which, as illustrated, strikes against the rim of the annular body 133 facing the bell shaped plate, the openings being visible at W1 and W2 and being in this position aligned relative to each other. By turning the bell shaped plate, pin 130 reaches the region of the molded slot 138 that leads out of the hollow shaft, with the pin also being positioned in the part of slot 136 that leads out of the annular body 133, so that the bell shaped plate can be pulled off the annular body 133 and out of the hollow shaft, with the annular body 133 retained by tool W remaining in the hollow shaft 132. The bell shaped plate is mounted in the reverse sequence.

An embodiment with a bayonet catch with a separate counterspring inside the hollow shaft is shown in FIG. 14A. In this case, the bell shaped plate 141, again without threaded connection but forming the cone illustrated, rests with its hub section 145 on the smooth inside surface of the hollow shaft 142. As illustrated, the wall of the hollow shaft 142 along its bell shaped-plate end 142' adjacent to the cone is thinner than the main part of the shaft on the opposite end. The bayonet catch construction comprises one, two or a plurality of pins 140 which are distributed around the axis of rotation to eliminate out-of-balance forces, and which are mounted in the hub section 145 and, projecting radially outward from the hub section, engage in one slot 146 each of the hollow shaft 142, the slot being, for example, a milled slot. As can be seen in FIG. 14B, slot 146 extends axially from the end of the hollow shaft into the hollow shaft and subsequently opens out into an inside portion 146' turned at right angles thereto, against the end of which pin 140 abuts in the operating position. In this position, the pin or pins 140 are secured by one spring element 143 each of the hollow shaft. In the example illustrated, the spring element 143 is formed by a tongue-shaped marginal portion on the bell shaped-plate end of the shaft itself, this end being separated by the slot 144, which is milled, e.g., into the extension of the inside portion 146' and is visible in FIG. 14B, from the axially inner portion of the shaft and which pushes in a spring-like fashion against pin 140. To protect the pin, slot and spring construction, for example, against dirt, a cover ring 147 is placed on the end of the hollow shaft 142 on the periphery of the hollow shaft.

To mount the bell shaped plate 141, its pin 140 is pushed axially into slot 146 and subsequently locked into position by turning the bell shaped plate in the inside portion 146' of the slot. The bell shaped plate is dismounted against the force of the spring element 143 in the reverse order. In this case (as in FIG. 12), the hollow shaft can be locked into position by means of a tool that can be applied to [recess] 149.

FIG. 15A again shows an embodiment with a bayonet catch without a counterspring inside the hollow shaft, which embodiment largely coincides with the embodiment according to FIG. 14, except that it has an additional lock to secure the operating position. In addition, the relatively thin terminal section 152' of the hollow shaft 152, which faces the bell shaped plate, is not molded in one piece onto the hollow shaft but instead is inserted as a separate axial extension into the inside wall of the hollow shaft. As in FIG. 14, two or more pins 150 mounted in the hub section 155 of the bell shaped plate 151 engage in each slot 156 that initially extends axially from the edge of the terminal section 152' and subsequently opens out into an inside portion 156' that is turned at right angles thereto, with the slot pin 150 being clamped by a spring element 153 that is formed, e.g., by milling the terminal section 152' of the shaft. Additional pins 158 (FIG. 15A) and 258 (FIG. 15B) serve as locking elements, the pins being mounted in an annular element 157 that is rotatably arranged on the periphery of the end section 152' of the shaft and projects radially inward from the annular element. One of the pins 158 engages on the bell shaped plate side terminal edge of the spring element 153 and pushes an axially inwardly projecting detent 153' of the spring element 153 against pin 150 such that the pin cannot be pushed out of the operating position shown in FIG. 15B by turning the bell shaped plate relative to the hollow shaft. The other lock pin 258 pushes against another spring element 253 that is arranged at a different point of the terminal section 152' of the shaft, e.g., a circumferentially opposite point, which spring element is similar to spring element 153, except that it has two axial indentations spaced apart from each other in the direction of rotation, in which, depending on the rotational position of the annular element 157 relative to the hollow shaft 152, the lock pin 258 can engage so as to prevent a self acting rotation of the annular element 157 and thus a release of the lock. An axial movement of the annular element 157 relative to the shaft is prevented, for example, by a limit stop construction between the annular element 157 and the terminal section 152', as indicated at the point designated by reference numeral 159.

To release the bell shaped plate 151 from its operating position shown in FIGS. 15A and 15B, the annular element 157 is rotated against the force of the spring element 253 such that the dismounting position of pins 158 and 258 shown in FIG. 15C results, in which dismounting position pin 158 releases the spring element 153 that abuts the pin 150 of the bell shaped plate. As a result, it is now possible to rotate the bell shaped plate 151 relative to the hollow shaft 152 and its terminal section 152' until pin 150 reaches the axial portion of slot 156, and the bell shaped plate can thus be pulled out in the axial direction. The bell shaped plate is mounted in the reverse sequence.

In all embodiments comprising a bayonet catch, the slots described can be arranged either in the hollow shaft itself or in a terminal section that is attached to the hollow shaft (as in FIG. 15A) or instead in the bell shaped plate or in a part that is attached to the bell shaped plate. Thus, depending on the location of the slots, the pins can be mounted in the bell shaped plate or in the shaft or in a part that is attached to the bell shaped plate or the shaft.

Figure 16A:
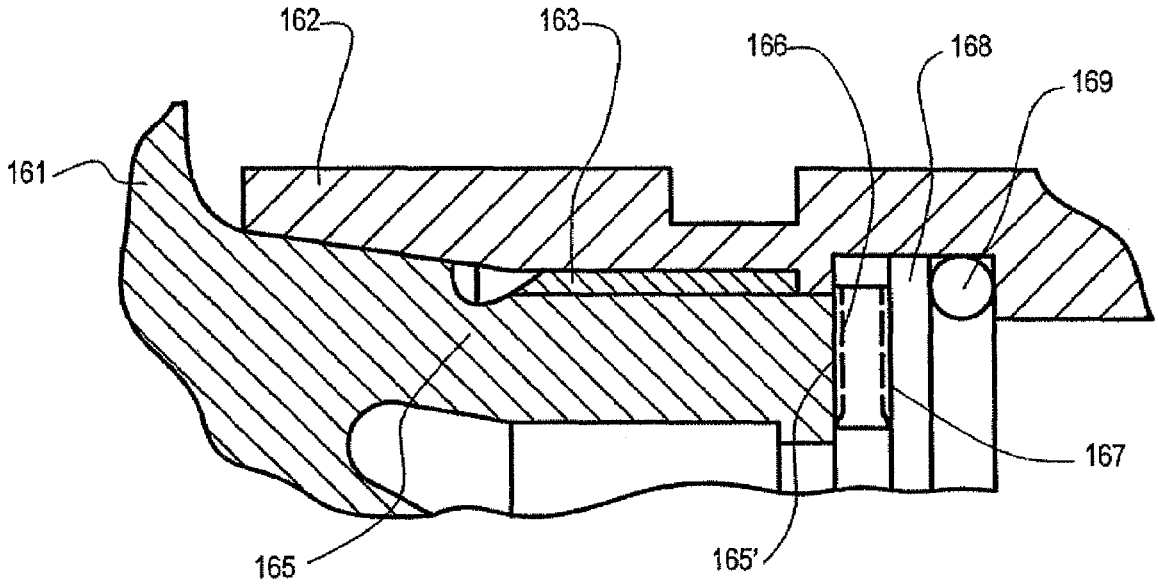
FIG. 16A-16C shows an embodiment with an axially acting click-stop device, in three views.

For clarity's sake, FIG. 16A shows only a portion of the open end of the hollow shaft 162 and the corresponding portion of the hub section 165 that is screwed into the hollow shaft. In this embodiment of the invention, the bell shaped plate 161, its hub section 165 which is partially conical so as to form a centering cone, and the threads 163 that are axially adjacent to the centering cone can have the conventional prior art design. To this extent, the construction could, for example, coincide with that of FIG. 1. The partial schematically-shown embodiment of the invention, however, differs from the prior art constructions in that notched means are provided in a front surface 165' of the hub section 165 that faces away from the bell shaped plate and that runs at right angles to the axis of rotation, for example, a crown of front teeth 166 coaxially projecting from the front surface 165', which front teeth 166 engage in an axially oppositely lying wreath of catch teeth 167 of the hollow shaft 162 whenever the bell shaped plate in its mounting position is screwed into the hollow shaft.

The catch teeth 167 can project axially, for example, from the front surface of an annular element 168 that faces the bell shaped plate, which annular element, when in the mounting position, can be prevented from making a relative movement but which can be inserted by axial movement into the hollow shaft 162. A spring device arranged at the rear, which faces away from the bell shaped plate, of the annular element 168 axially pushes the annular element against the front teeth 166 of the bell shaped plate. This spring element, for example, may simply be an elastic O-ring 169 that is inserted in the hollow shaft. The relative rotation of the annular element 168 in the hollow shaft can be prevented by the frictional force of the O-ring 169 or even by a form locking guide.

If, in this embodiment, torques arise because the shaft locks up or because of other abrupt changes in the speed that could cause the bell shaped plate to unscrew itself from the shaft, the bell shaped plate is prevented from unscrewing itself because the front teeth 166 engage in the catch teeth 167. Unscrewing the bell shaped plate for the purpose of dismounting it, on the other hand, is easy since, given an appropriate flank shape of teeth 166 and/or 167 and a correspondingly higher torque, the annular element 168 can be axially pushed back by teeth 166 against the spring force, for example, of the O-ring 169. It is also conceivable that the annular element 168 can be pushed back by means of a tool. The bell shaped plate is mounted using the reverse sequence.

Figures 16B, 16C:
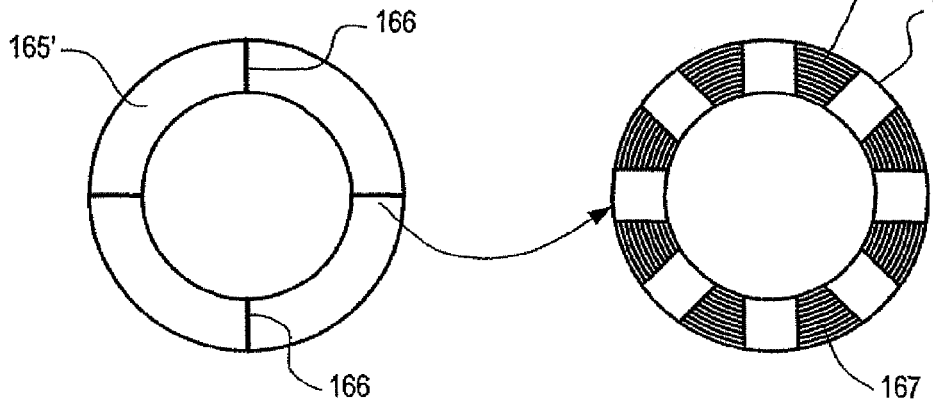

FIGS. 16B and 16C illustrate potential embodiments of the front-side teeth of the bell shaped plate and of the spring loaded shaft insert. For example, the number of catch teeth 167 of the annular element 168 can be greater than the number of catch teeth 166, that can be made to engage with the catch teeth of the hub of the bell shaped plate, as illustrated by the broken arrow. A reverse configuration is possible as well, as is a larger or a smaller number of teeth on the two sides of this catch configuration. To avoid out-of-balance forces, the teeth are invariably distributed around the axis of rotation at uniform angular distances from one another.

Figure 17A:
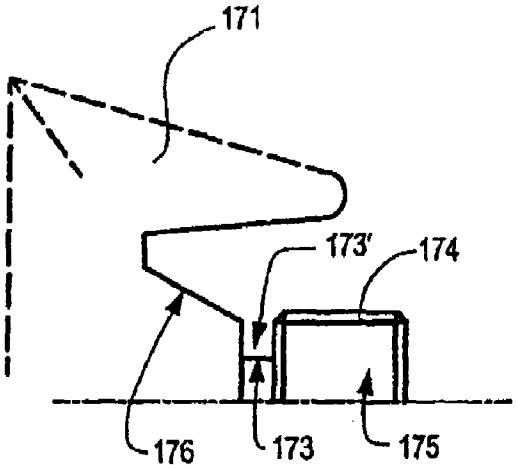
FIG. 17A-17C shows three views of another embodiment of the invention with a retaining ring as its special feature.
Figure 17C:
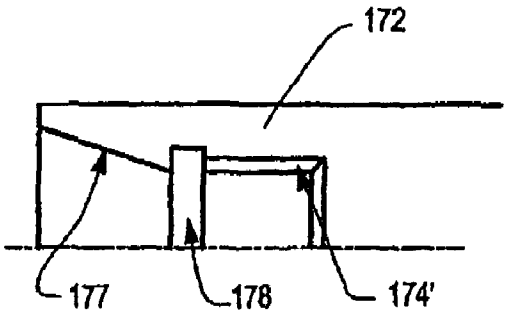
Figure 17B:
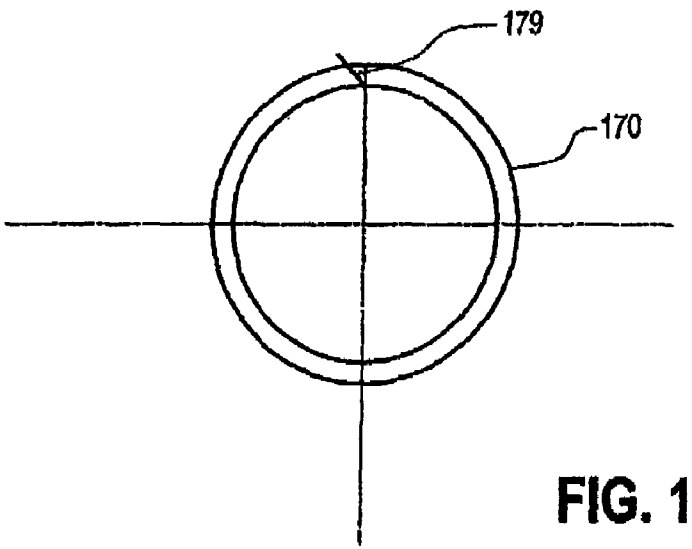

FIGS. 17A and 17B shows only a schematically represented and highly simplified embodiment of the present invention, in which the bell shaped plate 171 is prevented by a slotted retaining ring 170 from unscrewing itself from the hollow shaft 172 into which it is screwed in the conventional prior art manner. Axially adjacent to the centering cone 176, the bell shaped plate 171, which in the drawing is shown separately from the hollow shaft 172, has the standard hub section 175 with the external thread 174 which correspond to the conical inside surface 177 and the internal thread 174' of the hollow shaft 172.

Between cone 176 and the hub section 175 of the bell shaped plate 171, a cylindrical hub section 173 with an outside diameter that is smaller than the external thread 174 is formed by a radial recess. Once the bell shaped plate has been screwed into the hollow shaft, the hub section 173 is axially aligned with an annular groove 178 of at least approximately the same width, which annular groove is formed by a recess in the inside wall of the hollow shaft 172 between the inside surface 177 and the internal thread 174'.

In the recess or annular gap 173' that is formed between cone 176 and the hub section 175 of the bell shaped plate, a retaining ring 170, subdivided completely by the slot 179 that in FIG. 17B shown running at an incline relative to the radial direction, is placed in the periphery of hub section 173, through the annular body, the outside diameter of the retaining ring being smaller than that of the external thread 174 or at least than the radially most narrow inside part of the shaft in front of the internal thread 174', thus ensuring that the outside diameter does not interfere with the mounting and intended dismounting of the bell shaped plate, respectively, in and from the hollow shaft. As the bell shaped plate rotates during operation, on the other hand, the retaining ring 170 expands radially due to centrifugal force and the slanted slot 179 to form an outside diameter large enough so that it prevents the bell shaped plate from unscrewing itself, e.g., when the shaft locks up, since it strikes against the shoulders that bound the annular gap 173' of the bell shaped plate and the groove 178 of the hollow shaft. For reasons of dynamics, the retaining ring 170 should preferably be as lightweight as possible, for example, be made of a synthetic material, and like the hub section 173 and the groove 178, it should have the smallest possible diameter.

According to a potential modification (not shown) of the embodiment according to FIGS. 17A and 17B, an elastic O-ring with an appropriate outer diameter can be inserted into the annular gap 173' and the groove 178, which outer diameter allows the intentional mounting and dismounting of the bell shaped plate but by means of frictional forces prevents an accidental unscrewing of the bell shaped plate.

Figure 18B:
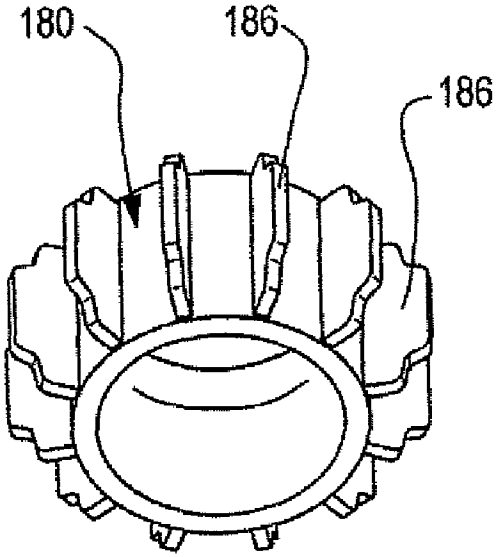
FIG. 18A-18B shows an embodiment of the invention with a slotted bell shaped plate thread, in two views.
Figure 18A:
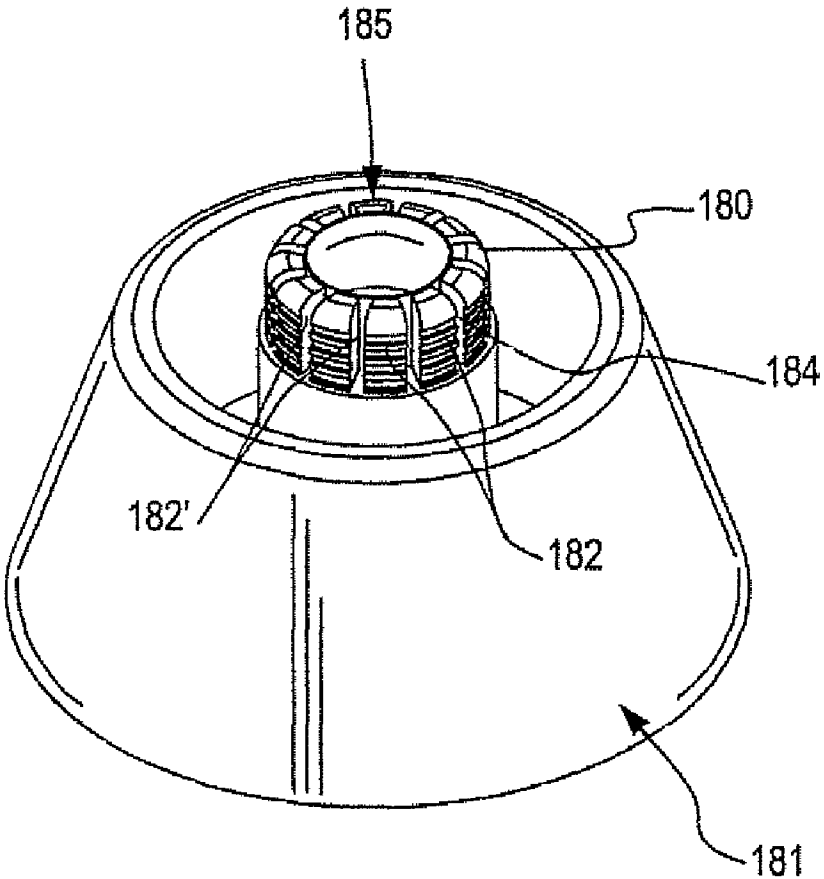

FIG. 18A shows a bell shaped plate 181 which, in similar fashion to the embodiment according to FIG. 17A (and thus as in FIG. 1), has a hub section 185 with an external thread 184 adjacent to a centering cone, by means of which it is screwed into the hollow shaft (not shown).

In this embodiment, the threaded connection is secured against a self-acting detachment in that a plurality of slots 182', which extend axially up to the shaft-end rim of the hub section 185 having the shape of a hollow cylinder, and which pass completely through the wall of the hub section, divide the thread 184, as illustrated, into a corresponding number of elastic segments 182. The outside diameter of the thread 184 that is formed by the segments 182 is dimensioned to ensure that it rests against the inside diameter of the hollow shaft with a sufficiently high initial tension to lock the threaded connection, with this inside diameter pushing the segments radially inwardly against the elastic force while screwing them in place.

According to an additional feature of the invention that is important for this particular embodiment, the annular body 180 shown in FIG. 18B is inserted into the cylindrical inside chamber of the slotted hub section 185, the cylindrical outside surface of which annular body lies against the cylindrical inside wall of the hub section 185 and thus seals slots 182' with respect to the inside. To this end, the annular body 180 is preferably made of a rubber elastic material so that it does not interfere with the necessary elastic movements of the thread segments 182 as the bell shaped plate is screwed in or unscrewed, but instead increases the elastic force of the segments.

Sealing the slots 182' with respect to the inside is important, among other things, in rotary sprayers in which a fluid may be contained in the inside chamber of the hub section, such as is the case, e.g., in the rotary sprayer described in PP 0 715 896, where a rinsing fluid is passed from the inside chamber of the bell shaped body to the outside surface of the bell shaped body.

According to FIG. 18B, radially projecting flat bridge like structures 186 are molded onto the outside surface of the annular body 180, which bridge like structures can be dimensioned and configured such that they engage in slots 182' and completely fill at least the radially inside areas of the slots.

According to a conceivable modification of the embodiment described, the terminal section of the hollow shaft could be designed in the form of elastic thread segments by means of longitudinal slots. In this case, the preferably rubber elastic annular body 180 described could be inserted into the terminal section of the hollow shaft.

Figure 19A:
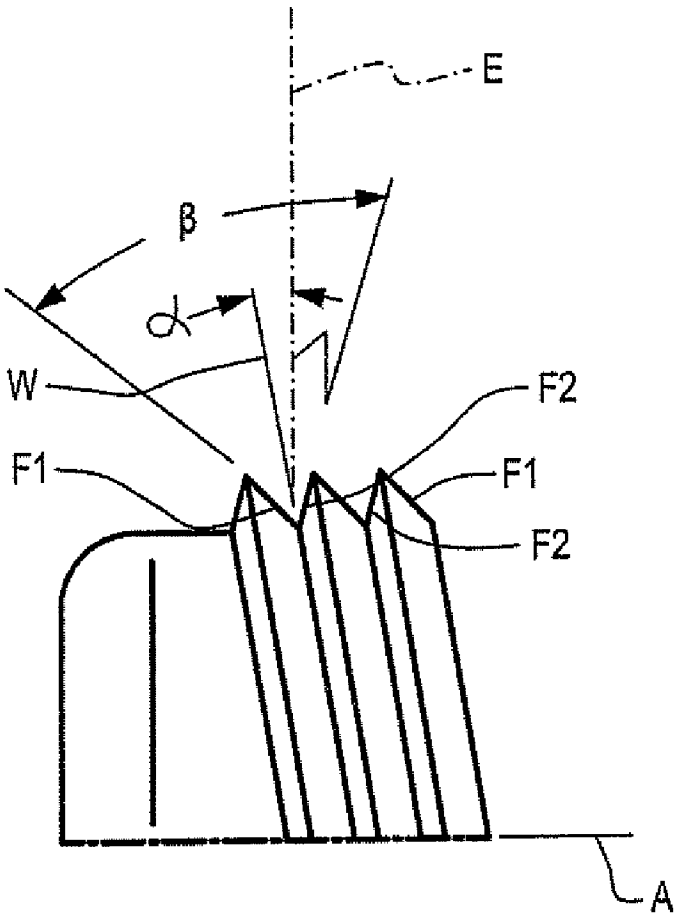
FIG. 19A-19B shows an embodiment of the invention with a special thread, in two views.

According to another embodiment of the invention that is illustrated in FIG. 19A, the threads by means of which a bell shaped plate is screwed to the associated shaft, for example, as shown in FIG. 1, can be configured and designed such that, compared to the conventional prior art threads (FIG. 19B), a larger retaining force is obtained by increasing the frictional forces that counteract unscrewing of the bell shaped plate. With respect to the thread shown in FIG. 19A, this is implemented in that the angle bisector W of the included flank angle $\beta$ of the thread is sloped by a certain angle $\alpha$ relative to the radial plane E located perpendicular to the axis of rotation A, so that, given the same outside diameter, one flank area F1 is larger than the other oppositely lying flank area F2. As illustrated, the direction of slope corresponds to the direction of pitch (right-hand or left-hand) of the thread such that when the bell shaped plate is screwed in, the flanks having the larger area are pressed against one another. The increase in flank compression and thus in the frictional force results from the greater length and greater area of the compressed flanks of the identically designed threads of the bell shaped plate and the hollow shaft. In the case of the illustrated thread with a flank angle of 60°, the angle of slope a measures approximately 20°, but it can also be larger or smaller and can range, for example, between 5° and 25°. In the case of the external thread of the bell shaped plate shown in FIG. 19A, the conventional centering cone of the bell shaped plate is preferably adjacent to what in the drawing is the right side of the thread.

Figure 19B:
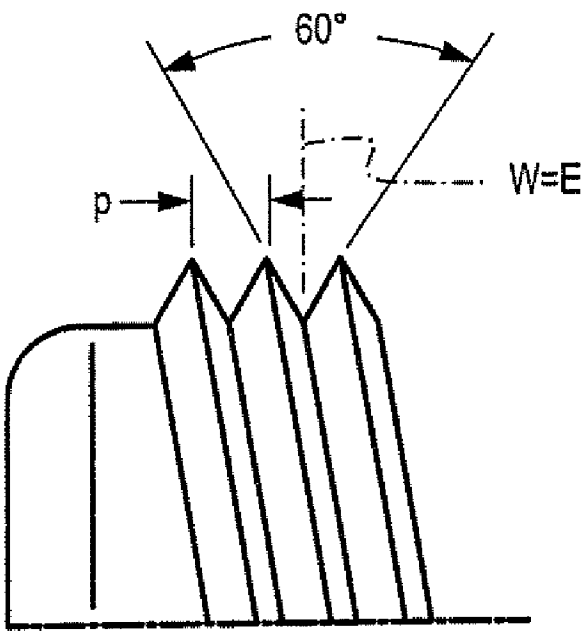

Except for the angle of slope $\alpha$, the thread can be a standard thread conventionally used for bell shaped plates, such as is shown in FIG. 19B for comparison. Conventionally used are, e.g., standardized fine thread sizes, such as M18×1 (nominal diameter 18 mm, thread pitch 1 mm).

The special thread shown in FIG. 19A can be produced, for example, by means of a 60° turning tool which, in contrast to the position at a right angle normally used, is placed at an oblique angle to the surface of the work piece, the angle corresponding to angle $\alpha$.

All of the embodiments in which the hub section of the bell shaped plate is inserted into a hollow shaft can be modified, without changing the underlying principle described, in that the hollow shaft can form the inside component and the hub section of the bell shaped plate can form the outside component of the threaded connection.

Furthermore, it should be noted that it is possible to combine the different embodiments of the invention described in any conceivable way, and that the features of such combinations may also be useful for any other embodiments.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A rotary sprayer for a coating apparatus, comprising:

a spraying body for a coating material, the spraying body configured to be mounted on a drive shaft of a drive motor for rotation with the drive shaft during a coating procedure, the spraying body including a detachable mounting device for coaxial connection of a connecting component of the spraying body to the drive shaft;

wherein the detachable mounting device includes a first mechanism and a second mechanism, at least the first mechanism configured to selectively secure the spraying body to the drive shaft, the second mechanism configured to prevent a self-acting complete detachment of the mounting device from the drive shaft when the spraying body is decelerated and accelerated with the drive shaft such that the first mechanism would, in the absence of the second mechanism, allow an undesirable movement of the spraying body radially about an axis of rotation of the drive shaft, the second mechanism being inactivated when the spraying body is not being rotated with the drive shaft such that the mounting device may be unfastened from the drive shaft;

wherein a limit stop construction is provided, which, after unfastening the first mechanism, the second mechanism provides a limit stop that limits accidental axial relative movement between the spraying body and the drive shaft, and forms a guide for the spraying body to prevent radial relative movements between the spraying body and the drive shaft.

2. The rotary sprayer of claim 1, characterized in that the spraying body is attached to the drive shaft with a threaded connection with elements of the limit stop construction striking against one another after unfastening of the threaded connection.

3. The rotary sprayer of claim 1, characterized in that limit stop elements are formed by at least one of thread elements, radial projections of the spraying body, an annular body attached to the spraying body, and an annular body attached to the drive shaft.

4. The rotary sprayer of claim 3, characterized in that one of the limit stop elements is formed by a molded spring washer that is inserted into an annular groove of the drive shaft and that the other limit stop element is formed by at least one of a radial projection of the spraying body, the projection being axially guided by the drive shaft, and an annular body attached to the projection.

5. A rotary sprayer for a coating apparatus, comprising:

a spraying body for a coating material, the spraying body configured to be mounted on a drive shaft of a drive motor for rotation with the drive shaft during a coating procedure, the spraying body including a detachable mounting device for coaxial connection of a connecting component of the spraying body to the drive shaft;

wherein the detachable mounting device includes a first mechanism and a second mechanism, at least the first mechanism configured to selectively secure the spraying body to the drive shaft, the second mechanism configured to prevent a self-acting complete detachment of the mounting device from the drive shaft when the spraying body is decelerated and accelerated with the drive shaft such that the first mechanism would, in the absence of the second mechanism, allow an undesirable movement of the spraying body radially about an axis of rotation of the drive shaft, the second mechanism being inactivated when the spraying body is not being rotated with the drive shaft such that the mounting device may be unfastened from the drive shaft;

wherein the spraying body is attached to the drive shaft with a threaded connection, characterized in that at least one of the drive shaft, a component attached to the drive shaft, the spraying body, and an annular body attached to the spraying body has a first thread and a second thread that are separated by an axial distance along the axis of rotation of the drive shaft from each other, the axial distance being greater than a pitch of each of the first and second threads.

6. The rotary sprayer of claim 5, further comprising a third thread, wherein the third thread has a larger diameter than each of the first and second threads.

7. The rotary sprayer of claim 5, characterized in that the first thread is a right-hand thread and the second thread is a left-hand thread.

8. The rotary sprayer of claim 5, characterized in that in a mounted state of the spraying body, only one of the first and second threads mates with a mating thread.

* * * * *